US005611285A

United States Patent [19]

Saxton

[11] Patent Number: 5,611,285

[45] Date of Patent: Mar. 18, 1997

[54] MULTIPURPOSE RAILRAOD WELL CAR

[75] Inventor: Gregory J. Saxton, Portland, Oreg.

[73] Assignee: Gunderson, Inc., Portland, Oreg.

[21] Appl. No.: 601,651

[22] Filed: Feb. 14, 1996

Related U.S. Application Data

[63] Continuation of Ser. No. 379,204, Jan. 27, 1995, abandoned, which is a continuation-in-part of Ser. No. 158,260, Nov. 23, 1993, Pat. No. 5,423,269, which is a continuation-in-part of Ser. No. 982,289, Nov. 24, 1992, Pat. No. 5,279,230.

[51] Int. Cl.[6] ..... B61D 3/00

[52] U.S. Cl. ..... 105/355; 105/4.1; 410/54; 410/55; 410/56

[58] Field of Search ..... 105/4.1, 4.2, 4.3, 105/355; 410/56, 57, 54, 55

[56] References Cited

U.S. PATENT DOCUMENTS

| | | | |
|---|---|---|---|
| 1,085,196 | 1/1914 | Downing . | |
| 1,696,332 | 12/1928 | Sheehan . | |
| 1,699,520 | 1/1929 | Gibbs et al. . | |
| 1,875,584 | 9/1932 | Frede et al. . | |
| 1,889,605 | 11/1932 | Jones . | |
| 2,052,213 | 8/1936 | Branstrator | 20/6 |
| 2,278,554 | 4/1942 | Morton | 94/11 |
| 2,279,756 | 4/1942 | Lieberman | 105/457 |
| 2,401,401 | 6/1946 | Bartsch | 105/457 |
| 3,102,613 | 9/1963 | Johnston | 189/34 |
| 3,152,669 | 10/1964 | Johnston | 189/34 |
| 3,181,440 | 5/1965 | Mullaney et al. | 94/5 |
| 3,357,371 | 12/1967 | Gutridge | 105/366 |
| 3,420,192 | 1/1969 | Ellis | 105/422 |
| 3,731,967 | 5/1973 | Hughes | 296/1 |
| 4,091,742 | 5/1978 | Cordani | 105/366 |
| 4,179,997 | 12/1979 | Kirwan | 410/53 |
| 4,233,909 | 11/1980 | Adams et al. | 105/4 |
| 4,274,776 | 6/1981 | Paton et al. | 410/57 |
| 4,288,957 | 9/1981 | Meehan | 52/460 |
| 4,452,147 | 6/1984 | Jwuc | 105/4 |
| 4,456,413 | 6/1984 | Pavlick | 410/56 |
| 4,524,699 | 6/1985 | Pavlick | 105/4 |
| 4,671,714 | 6/1987 | Bennett | 410/57 |
| 4,686,907 | 8/1987 | Woollam et al. | 105/4.1 |
| 4,703,699 | 11/1987 | Hill | 105/355 |
| 4,718,353 | 1/1988 | Schuller et al. | 105/406.1 |

(List continued on next page.)

FOREIGN PATENT DOCUMENTS

| | | |
|---|---|---|
| 0392828 | 10/1990 | European Pat. Off. . |
| 0510467 | 10/1992 | European Pat. Off. . |
| 0510372 | 10/1992 | European Pat. Off. . |

OTHER PUBLICATIONS

"An All–Purpose Flat Car", Railway Age, pp. 35–37, May 1954.

"Honeycomb Wall Panels", Popular Mechanics, Jul. 1946, p. 147.

Paton Corporation preliminary drawing of a "Low–Pro" center car, dated Nov. 14, 1977. Not reduced to practice.

*Primary Examiner*—Mark T. Le

*Attorney, Agent, or Firm*—Chernoff, Vilhauer, McClung & Stenzel

[57] ABSTRACT

A railroad freight car including a cargo well for carrying optionally either intermodal cargo containers or highway semitrailers has a side sill structure including a deep rectangular top chord and a depending web, supporting a well floor structure. The well floor structure includes reinforcing longitudinal and transverse channel members and horizontal top and bottom plates attached to the channels. Large circular openings, aligned with one another, are defined in both the top and bottom plates, and a peripheral ring of vertical material interconnects the margins of the top and bottom plates around the openings. A reinforcing walkway structure is located atop each side sill at each end of the cargo well. In a multi-unit car adjacent car units are supported on a single shared wheeled truck. A trailer hitch is carried on a body bolster of one of the adjacent units to support the front end of trailer whose wheels rest on the floor of the cargo well of the other of the adjacent units, so that a trailer otherwise too long can be carried on the multi-unit car.

22 Claims, 20 Drawing Sheets

U.S. PATENT DOCUMENTS

| | | | |
|---|---|---|---|
| 4,771,706 | 9/1988 | Lindauer et al. | 105/415 |
| 4,782,762 | 11/1988 | Johnstone et al. | 137/355 |
| 4,862,810 | 9/1989 | Jamrozy et al. | 105/355 |
| 4,876,968 | 10/1989 | Lindauer et al. | 105/415 |
| 4,889,055 | 12/1989 | Jamrozy et al. | 105/355 |
| 4,929,132 | 5/1990 | Yeates et al. | 410/56 |
| 4,949,646 | 8/1990 | Jamrozy et al. | 105/406.2 |
| 4,966,082 | 10/1990 | Takeichi et al. | 105/422 |
| 5,001,990 | 3/1991 | Pavlick | 105/375 |
| 5,017,064 | 5/1991 | Kirwan et al. | 410/53 |
| 5,020,445 | 6/1991 | Adams, Jr. | 105/4.1 |
| 5,207,161 | 5/1993 | Pileggi et al. | 105/4.1 |
| 5,216,956 | 8/1993 | Adams, Jr. | 105/4.2 |
| 5,246,321 | 9/1993 | Hesch | 410/58 |
| 5,279,230 | 1/1994 | Thomas et al. | 105/355 |
| 5,407,309 | 4/1995 | Hesch et al. | 410/54 |
| 5,452,664 | 9/1995 | Richmond | 105/4.1 |

MULTIPURPOSE RAILRAOD WELL CAR

This application is a continuation of application Ser. No. 08/379,204, filed Jan. 27, 1995 (now abandoned), which is a continuation-in-part of U.S. patent application Ser. No. 08/158,260, filed Nov. 23, 1993 (now U.S. Pat. No. 5,423,269), which is a continuation-in-part of U.S. patent application Ser. No. 07/982,289, filed Nov. 24, 1992 (now U.S. Pat. No. 5,279,230).

BACKGROUND OF THE INVENTION

The present invention relates to railroad freight cars, and particularly to a multi-unit railway freight well car of lightweight construction, for optionally carrying either intermodal cargo containers stacked one upon another or over-the-highway freight trailers supported on their own running gear in a cargo well of any car unit of the multi-unit car.

Railroad car units for carrying over-the-highway freight trailers are well known, as are multi-unit railroad freight cars defining cargo or container wells for carrying various combinations of intermodal cargo containers stacked one upon another in two tiers. Because the total weight which can be carried upon the rails limits the net amount of cargo which can be carried on a railroad freight car unit, it is desirable for a well car unit to be constructed in a configuration having a minimum tare weight consistent with the strength required to safely support a combination of cargo containers and trailers for which the car unit is configured. It is also necessary, however, to provide an adequate surface to support the tires of trailers carried in the cargo well. Additionally, it is necessary for a car unit to be strong enough to withstand the many forces resulting from movement of the laden car unit as part of a train.

Some highway freight trailers are longer than the cargo wells commonly provided for receiving stacked containers in the car units of such multi-unit well cars, but it is preferred not to build car unit bodies with longer wells to accommodate such trailers because of the limitation of cargo capacity resulting from the extra weight of such a longer car unit body. Nevertheless, it is desired to be able to carry such longer trailers safely in such multi-unit well cars. At the same time, it is desirable to provide in a railroad freight car the ability to carry a widely variable mix of containers and trailers of various sizes, and thus to minimize the number of spaces for trailers or containers left empty in loading the car units of a train.

To carry trailers efficiently in a well car unit it is necessary to provide a shallow well depth from a floor top surface to the top of a side sill, to give trailer loading equipment access to the bottom of a trailer floor above the side sills so that trailers can handily be inserted into and extracted from the well. The reduction of bending resistance resulting from shallower side sills must be restored by other structure.

Well car units utilize inter-box connectors (IBCs) to interconnect upper and lower containers when they are carried stacked one atop another in a well car unit. IBCs are usually located at a standard position between such stacked containers, corresponding to the location of an end of a standard intermodal container 40 feet long, for example, even though it is possible that a container more than 40 feet long may be carried.

It is necessary for a person to reach the IBC to operate it to interconnect or disconnect containers when a container is being loaded onto or removed from atop a lower tier container carried in a well of such a car unit. Since some containers are over 9' high, it may be difficult to reach the IBCs when standing atop a side sill of a well car unit, particularly one which has relatively low side sills. There is additional risk of falling where a well car unit is intended to carry containers having lengths greater than 40 feet. Some car units for carrying stacked containers therefore include walkways on which a person can stand to reach IBCs.

Some railroad freight car units are designed to carry trailers, or chassis and attached intermodal cargo containers, in a cargo well also equipped to carry stacked containers. The structure of such well car units must satisfy certain requirements. First, any walkways intended to provide access to IBCs interconnecting stacked containers carried in such a car unit should be located where they will not interfere with the proper operation of cranes used to move trailers into or out of such car units.

Second, it is necessary for the car unit structure to carry loads, imposed upon the car unit by the weight of containers or trailers, from the side sills to the wheeled trucks supporting the car unit. However, such loads are concentrated in the side sill structure of the car unit near the ends, because of the need for clearance for the wheeled trucks to pivot.

What is needed, then, is an improved multi-unit railroad car including cargo wells for optionally carrying either stacked containers or trailers of various lengths, including trailers longer than the cargo well in a car unit, yet without restricting availability of the cargo well of an adjacent car unit, and in which a well floor structure and the connection of such a well floor to other parts of the car provide adequate strength without unnecessary weight, yet with shallow well depth and small floor thickness, and in which provision is made for a person to reach and operate inter-box connectors safely when containers are stacked in the cargo well.

SUMMARY OF THE INVENTION

The present invention provides an answer to the needs enumerated above and overcomes the aforementioned shortcomings of the prior art by providing a multi-unit railroad freight car including at least two interconnected car units each including a body defining a cargo well. Preferably, a shared wheeled truck supports adjacent ends of respective adjacent car units. One embodiment of a multi-unit railroad freight car having a shared wheeled truck is set forth in U.S. Pat. No. 5,207,161 assigned to applicant's assignee, the disclosure of which is hereby incorporated herein by reference.

In one embodiment of the present invention a trailer hitch is mounted on a body bolster of a first one of the interconnected car units, and the road wheels of a trailer can be carried in the cargo well of the second one of the car units, with the front end of the trailer spanning the shared truck, and with the trailer hitch kingpin secured to the trailer hitch carried on the first one of the interconnected car units. The location of the trailer hitch on the car unit adjacent the car unit in whose cargo well the wheels of the trailer are supported allows carriage in the multi-unit car of a trailer longer than the maximum length trailer which could be carried otherwise in a car unit of the same length.

In one embodiment of the invention the trailer hitch defines a hitch kingpin location above the shared truck and between the respective body bolsters of the adjacent ends.

Preferably, each cargo well is defined in part by a pair of longitudinal side sills interconnected with a respective transverse body bolster at each end of the respective car unit. In one embodiment of the invention a longitudinally-extending side sill reinforcing structure is mounted atop a top chord of the side sill and extends along a portion of the top chord, alongside a portion of the cargo well adjacent one of the opposite ends of the car unit body. Preferably, a horizontal top of the reinforcing structure includes a raised walkway for supporting a person safely in the vicinity of interbox connectors used with containers stacked in the cargo well of such a car body.

In one embodiment of the invention the side sills of a body of a car unit are shallow and of light-weight construction and support a well floor of unified, lightened and stiffened structure attached to the side sills to form a light, yet strong and stiff, car body structure. Such a car unit is capable of withstanding the concentrated loads imposed by cargo containers and has the necessary floor area of sufficient strength to support the wheels of trailers at any longitudinal location, and still is sufficiently light in overall weight to permit carriage of stacked intermodal cargo containers without undue limitation of their net cargo weight.

In one embodiment of the invention the side sills include a deep rectangular top chord and a web of thin metal plate extending diagonally down to a well floor assembly. The well floor assembly is attached to the web continuously along its length, so that the well floor acts as a lower chord for the side sill, but is suspended beneath the top chord of the side sill along the entire length of the well floor.

The foregoing and other objectives, features, and advantages of the invention will be more readily understood upon consideration of the following detailed description of the invention, taken in conjunction with the accompanying drawings.

DETAILED DESCRIPTION OF A PREFERRED EMBODIMENT

Figure 1:
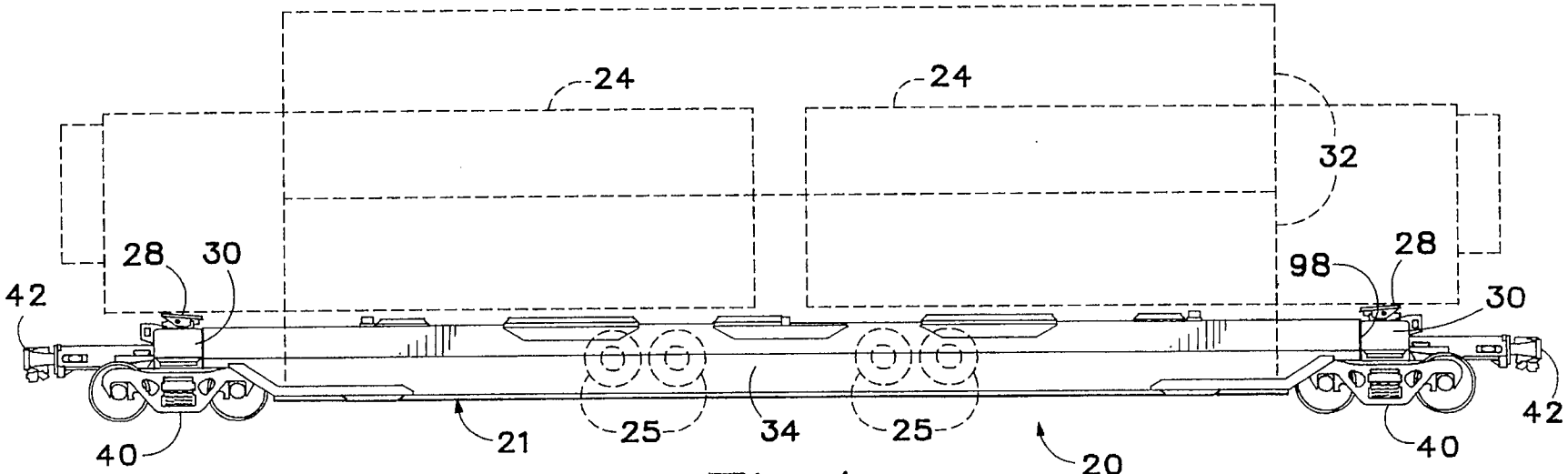
FIG. 1 is a side elevational view of a railroad freight car embodying the present invention and laden with a pair of semi-trailers carried in a cargo well defined in the car body.
Figure 2:
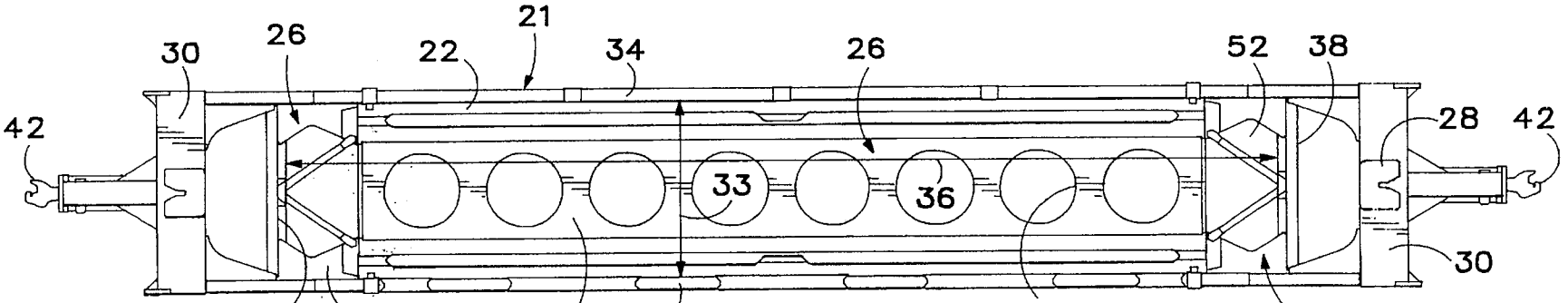
FIG. 2 is a top plan view of the railroad car shown in FIG. 1.

Referring first to FIGS. 1 and 2 of the drawings which form a part of the disclosure herein, a railroad freight car 20 has a car body 21 of welded steel which includes a cargo well 22 adapted to be laden by receiving trailers 24. As shown in phantom line in FIG. 1, the wheels 25 of the trailer rest on a floor assembly 26 which helps to define the cargo well 22, and a hitch kingpin portion near the front end 23 of each trailer 24 is secured to and supported on a fifth wheel trailer hitch 28 mounted atop a body bolster 30 located at a respective end of the car 20. Alternatively, intermodal cargo containers 32, also shown in phantom line in FIG. 1, may be carried in the cargo well 22, where two of such cargo containers can be stacked upon one another, supported by the floor assembly 26, within the vertical clearance space available along most railroads.

The well 22 has a width 33, defined between a pair of opposite side sills 34, and a length 36, defined between a pair of vertical transverse stiffeners 38. The length and width are great enough to receive a cargo container having a long standard length such as 48 feet, and a wide standard width such as 102 inches, or to receive a pair of short standard containers each 20 feet long.

A conventional four-wheeled truck 40 located under each body bolster 30 supports the car 20 on a railroad track (not shown), and conventional couplers 42 are provided at the ends of the car 20.

As may be seen in FIGS. 3–8, each of the side sills 34 includes a deep rectangular top chord 44 in the form of a longitudinal channel 45 of bent plate, 9/16 inch thick, for example, including a pair of flanges 46, extending horizontally outward. A ¼-inch-thick (for example) web plate 48 of the side sill 34 is welded to the flanges 46 extending vertically between them to close the top chord 44 and extends thence diagonally downwardly and inwardly as a lower panel 50 acting as a web of the side sill 34. A reinforcing angle member 49 welded to the plate 48 extends horizontally between the flanges 46 to reinforce the top chord 44 against buckling without adding an undesirable amount of weight. The lower panels 50, however, are essentially planar between the point of attachment to the respective lower flange 46 and lower margins of the panels 50, and thus carry bending forces from the floor assembly into the top chords 44 of the side sills 34. The side sills 34, thus, are very clean structurally with no additional major reinforcement members.

The well floor assembly 26 is of welded metal construction and is attached to and supported by lower panels 50 of the side sills 34, extending horizontally between them. Opposite end transition portions 52 of the floor assembly 26 are also attached to the lower panels 50 as well as to the vertical transverse stiffeners 38 which define the length 36 of the well 22. The end transition portions 52 carry longitudinal loads from the main portion 54 of the floor assembly 26 to the side sills 34 and to the transverse stiffeners 38 at each end of the car body 21.

Between the well floor end transition portions 52, the main portion 54 of the well floor assembly 26 is an integral rigid welded assembly, including a bottom plate 56 which may be in the form of two opposite side portions each about half the width of the floor assembly 26, extending horizontally for the length of the main portion 54 of the floor assembly 26 and joined together along a longitudinal center joint. The bottom plate 56 may be, for example, 5/32 inch thick.

A longitudinally extending transition channel member 58, of bent plate ⅜ thick, for example, extends along the top of each lateral margin of the bottom plate 56. The transition channel members 58 are specially configured, with a cross-section shape that includes a V-shaped channel portion 60 which has a pair of sides including a diagonally upwardly-and-outwardly directed outer flange portion 62. As may be seen best in FIG. 5, a bottom portion of the V-shaped channel 60 is welded to the lateral margin 64 of the bottom plate 56, while an upper margin of the outer flange portion 62 overlaps and is welded to the inner side of a lower margin 66 of the lower panel 50 of the web sheet 48, so that the floor assembly 26 is suspended from the top chords 44 and extends horizontally between the two side sills 34. Each transition channel member 58 further includes a horizontal transverse portion 68 connected with the other side of the channel 60, and a vertical flange portion 70 extending down from the transverse portion 68 and whose margin is welded to the top side of the bottom plate 56. Thus, the transition channel members 58 resemble a radical, or square root, sign.

The well floor end transition portions 52 each include a pair of transition plates 72 forming the lateral margins of the end transition portions 52. The transition plates 72 are ⅜ inch thick, for example, and extend from each end of the main portion 54 of the floor assembly 56 toward the respective vertical transverse stiffener member 38. Each transition plate 72 is welded to the inwardly extending transverse horizontal lower flange 74 of the respective stiffener 38, as may be seen best in FIG. 3.

A pair of diagonal box beams 76 extend from respective portions of the transition plates 72 adjacent the main portion 54 of the floor assembly 26, converging toward each other, and are welded to a central portion of the horizontal lower flange 74 of the respective transverse stiffener 38. The box beams 76 may be two inches by four inches overall in cross-section size, with a wall thickness of ⅛ inch, for example. A top cover plate 78 is welded to the tops of the beams 76. The top cover plate 78 extends down alongside the outer ends of the box beams 76 and is also welded to the flange 74 to further strengthen the attachment of the outer ends of the beams 76 to the transverse stiffener 38.

Figure 3:
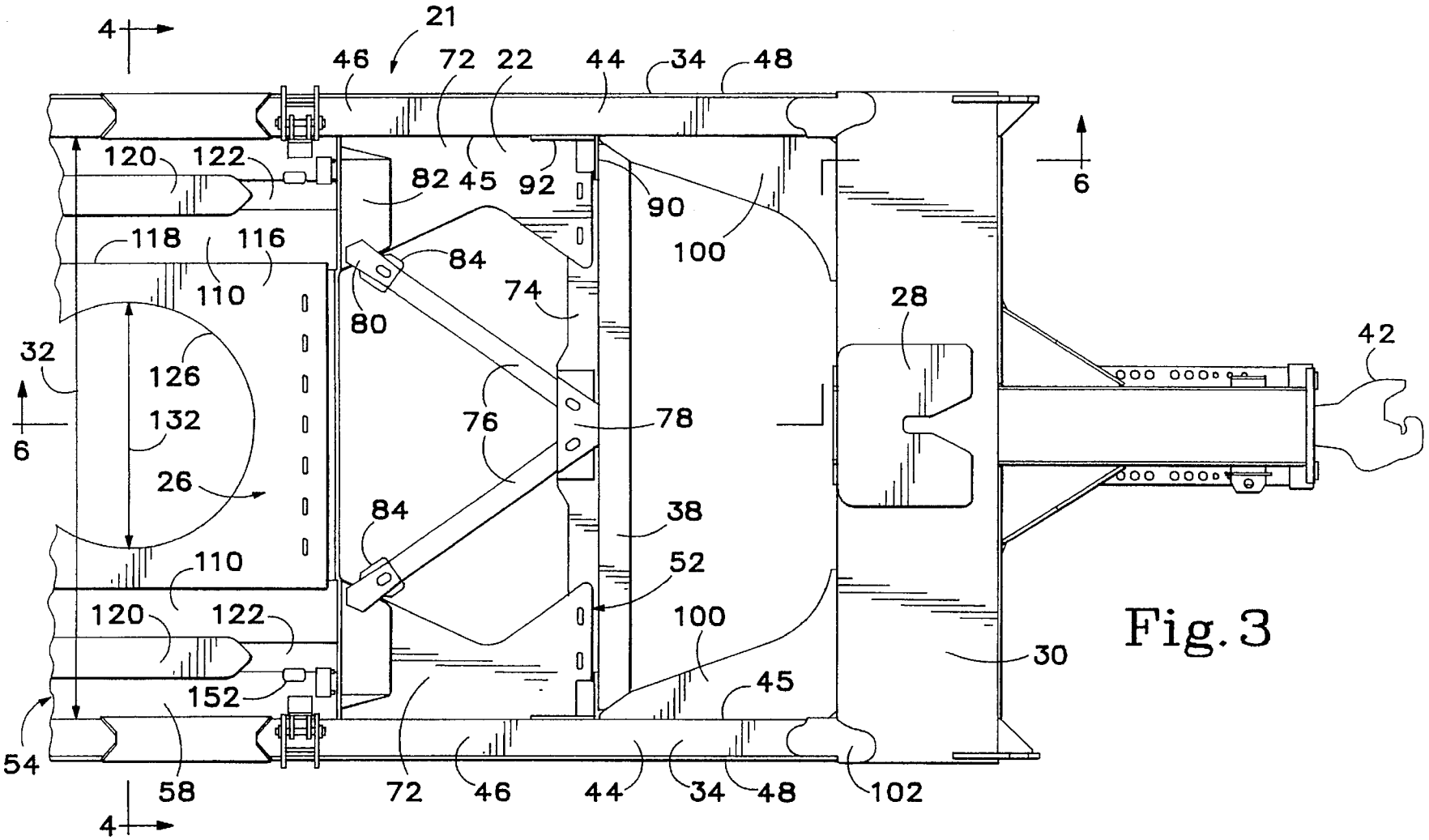
FIG. 3 is a top plan view, at an enlarged scale, of a portion of the car shown in FIGS. 1 and 2.
Figure 4:
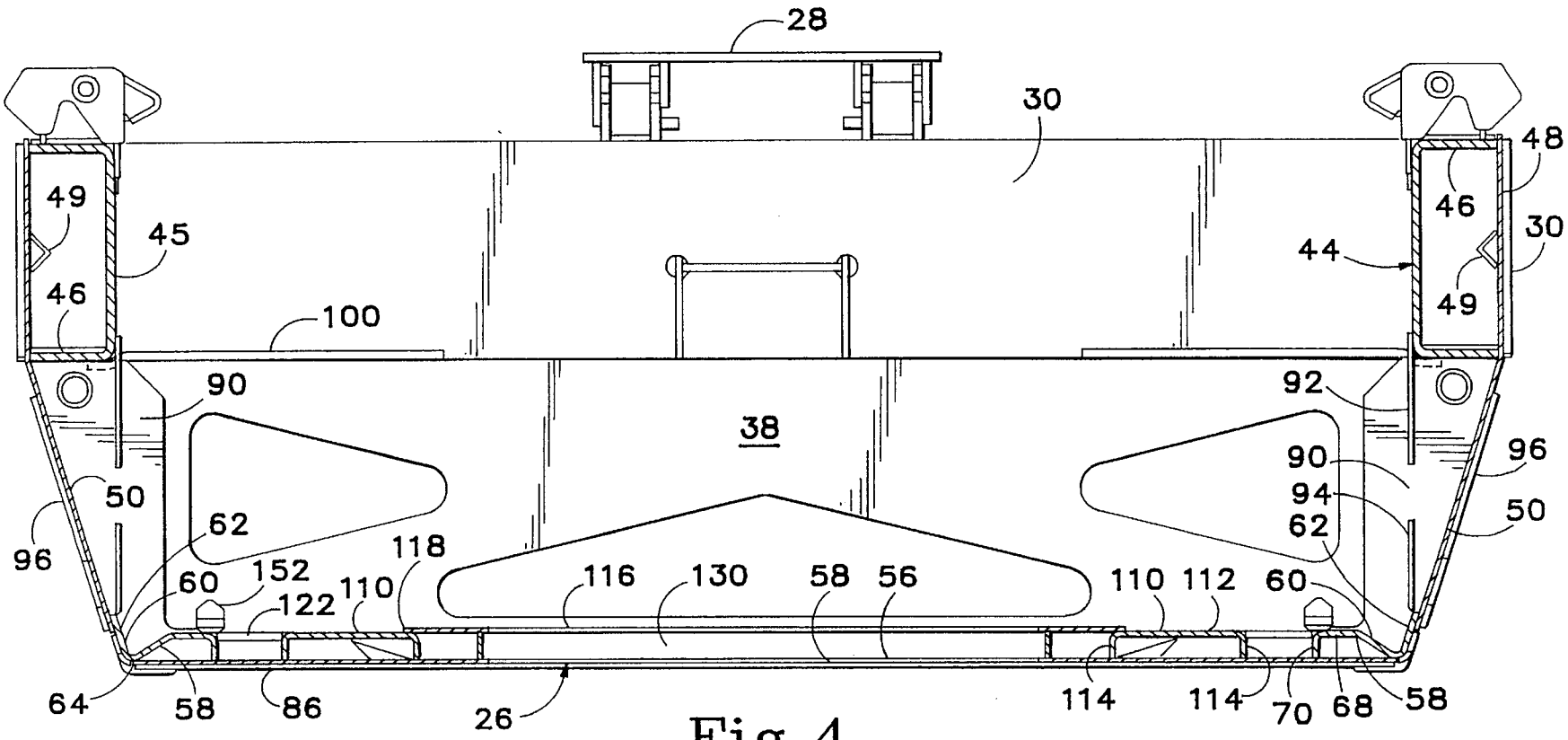
FIG. 4 is a sectional view of the body of the railroad freight car shown in FIGS. 1–3, taken along line 4—4 in FIG. 3, at an enlarged scale.
Figure 6:
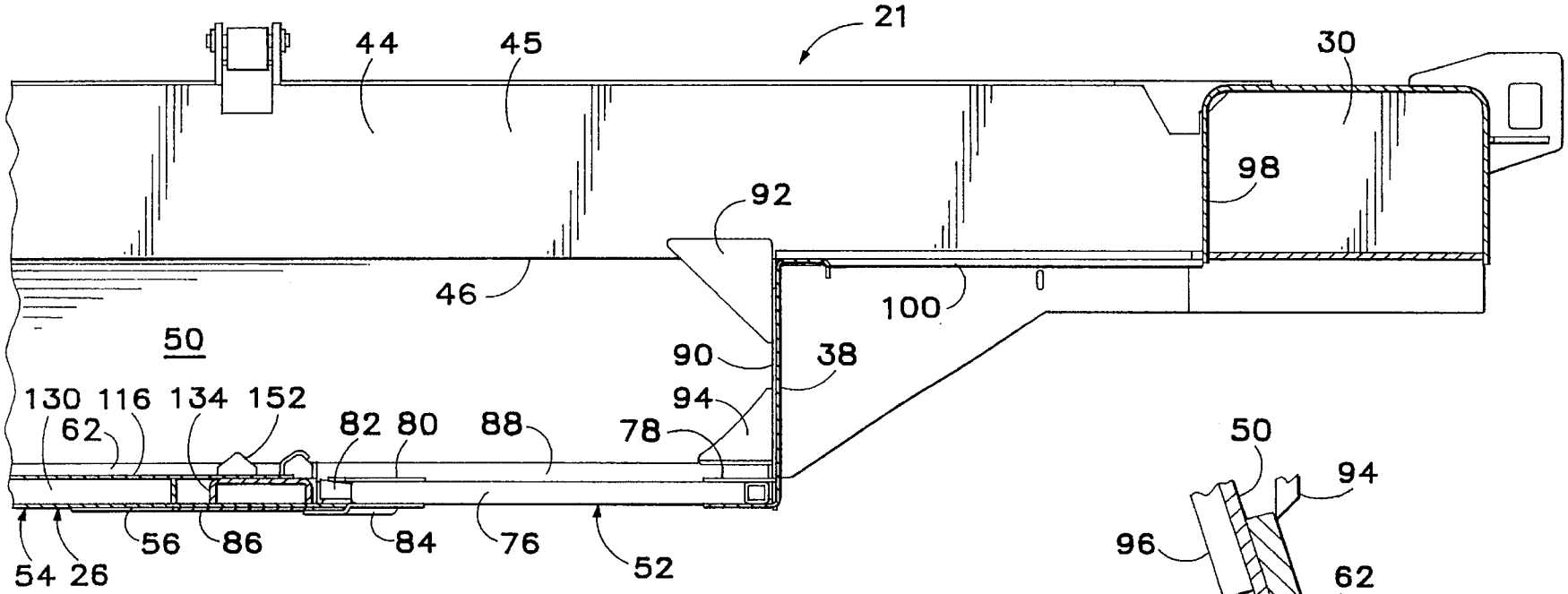
FIG. 6 is a sectional view of a portion of the body of the railroad freight car shown in FIGS. 1–3, taken along line 6—6 of FIG. 3, at an enlarged scale.
Figure 5:
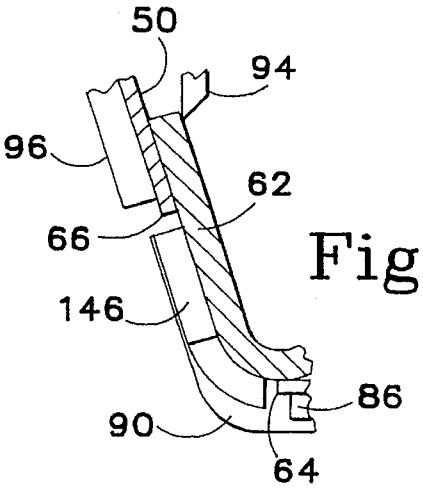
FIG. 5 is an enlarged sectional view of a detail of the portion of a railroad freight car body shown in FIG. 4.
Figure 7:
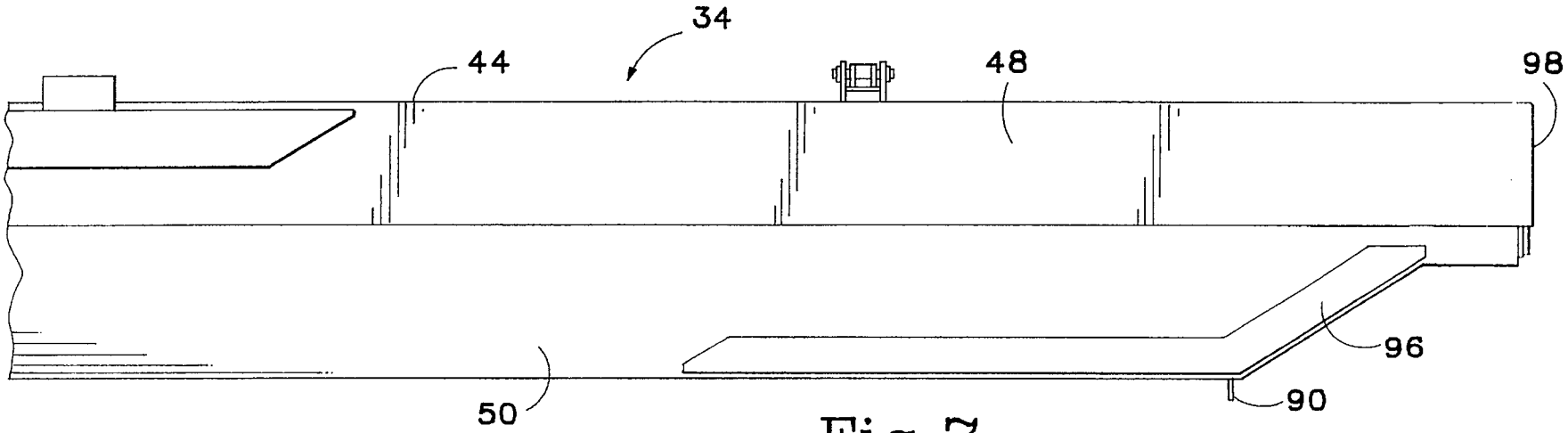
FIG. 7 is a side elevational view of a portion of a side sill of the railroad freight car shown in FIG. 1, at an enlarged scale.
Figure 8:
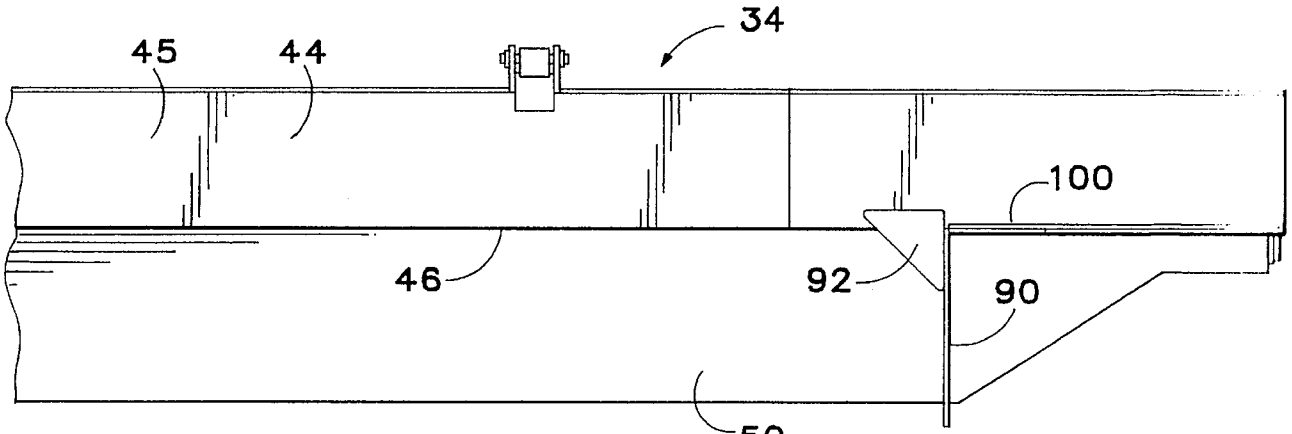
FIG. 8 is a side elevational view, at an enlarged scale, of a portion of a side sill shown in FIG. 1, taken in the direction indicated by the line 6—6 in FIG. 3.

Similarly, as shown also in FIGS. 3 and 6, a top attachment plate 80 is welded to the top of the other, or longitudinally inner, end of each of the beams 76 to attach it to the top of a respective transition ramp member 82 which forms a part of the attachment of the main portion 54 of the floor assembly 26 to the transition plate 72. A bottom attachment plate 84 also cooperates in attachment of the inner ends of the beams 76 to the transition plates 72, through a doubler plate 86 which is attached to the lower faces of the bottom plate 56 and the transition plate 72. The cover plates 78 and attachment plates 80 and 84 may all be 3/16 inch thick, for example.

A diagonally upwardly-and-outwardly extending flange 88 is a portion of each transition plate 72 and is welded to the lower margin 66 of the lower panel 50 of the web sheet 48 to attach the laterally outer margins of the transition plates 72 to the side sills 34.

A stub transverse stiffener 90 (FIGS. 4, 6, and 8) similar in thickness to the transverse stiffeners 38 supports the lower panel 50 of each web sheet 48 beneath the top chord 44 immediately adjacent the transverse stiffener 38, and is welded to the transverse stiffener 38 to interconnect it securely with the side sills 34 and define the end of the cargo well 22. A gusset 92 of similar material interconnects the stub transverse stiffener 90 with the channel 45 of the top chord 44, and a gusset 94 interconnects the upper margin of the outer flange portion 62 of the transition channel member 58 with the stub transverse stiffener 90.

The outer ends 98 of the side sills 34 are welded to each of the body bolsters 30. The body bolsters 30 are transversely-extending box beam structures similar to those used in other railroad well cars of recent design for carrying stacked intermodal cargo containers. The longitudinally outer portions of the lower panel 50 of each side sill 34, the portions extending beyond the transverse stiffeners 38, are diagonally tapered upwardly toward the top chord 44, providing clearance for the truck 40. A doubler plate 96 is provided on the outer side of the lower panel 50 to reinforce the margins of the lower panel 50 on each side of the transverse stiffeners 38.

Large, generally triangular, horizontal gusset plates 100 extend from the top flange of the transverse stiffener 38 to the lower portion of the body bolster 30. The gusset plates 100 carry substantial loads to the body bolster 30, and are therefore of substantial thickness, for example ¾ inch. An outer side margin portion of each gusset 100 extends beneath and is welded to the lower flange 46 of the respective top chord channel member 45, as seen best in FIG. 4. Reinforcing plates 102 strengthen the interconnection of the top flange 46 of the chord 44 of each side sill to the body bolsters, as shown in FIG. 3.

Referring now also to FIGS. 9–17, the longitudinally centrally located main portion 54 of the floor assembly 26 includes a pair of downwardly-open longitudinal channels 110, extending longitudinally of the floor assembly 26, each spaced laterally inward from and parallel with a respective transition channel member 58. Each longitudinal channel 110 may be of bent plate ⅜ inch thick, for example, and has a horizontal web 112 and a pair of vertical flanges 114 of equal size so that the web 112 is parallel with the bottom plate 56. The height of the longitudinal channels 110 is equal to that of the horizontal portion 68 of the longitudinal transition channels 58.

A generally rectangular top plate 116 extends horizontally between the longitudinal channels 110 and has its lateral margins 118 welded respectively to the inboard shoulder of the downwardly open longitudinal channel 110 on each side, so that the top plate 116 of the floor assembly 26 is spaced upwardly apart from the bottom plate 56 by a distance equal to the height of the longitudinal channel 110.

A cover plate 120, ⅜ inch thick, for example, is welded atop the confronting shoulders of each transition channel 58 and the nearby downwardly open longitudinal channel 110 to form an upper surface. The cover plate 120 is additionally supported by heavy doubler plates 122 ⅝ inch thick, for example, located between the confronting vertical flanges 114 and 70 at the positions along the length of the floor assembly 26 where concentrations of weight are to be expected. Doubler plates 122 are thus provided where the ends of a pair of end-to-end cargo containers are to be supported at the mid point of the length 36 of the well 22, and at the ends of the main portion 54 of the floor assembly 26, adjacent the transition plates 72, where the corner posts of the outer ends of containers are to be supported on locator cones. At the locations where the container corner castings are to be located the cover plate 120 is omitted, to provide a small amount of additional clearance.

The transition channel member 58, the cover plate 120, the doubler plate 122, and the longitudinally extending channel 110 all cooperate with the lower panel 50 of the web sheet 48 of the respective side sill 34 to carry loads which would be carried by a lower chord of the side sill 34 if one existed. Additionally, the horizontal transverse portion 68 of the transition channel members 58, the cover plates 120, and the horizontal webs 112 of the longitudinal channels 110 include suitably strong upper surfaces of the floor assembly 26 to support the wheels 25 of trailers 24 carried in the well as shown in FIG. 1.

Figure 10:
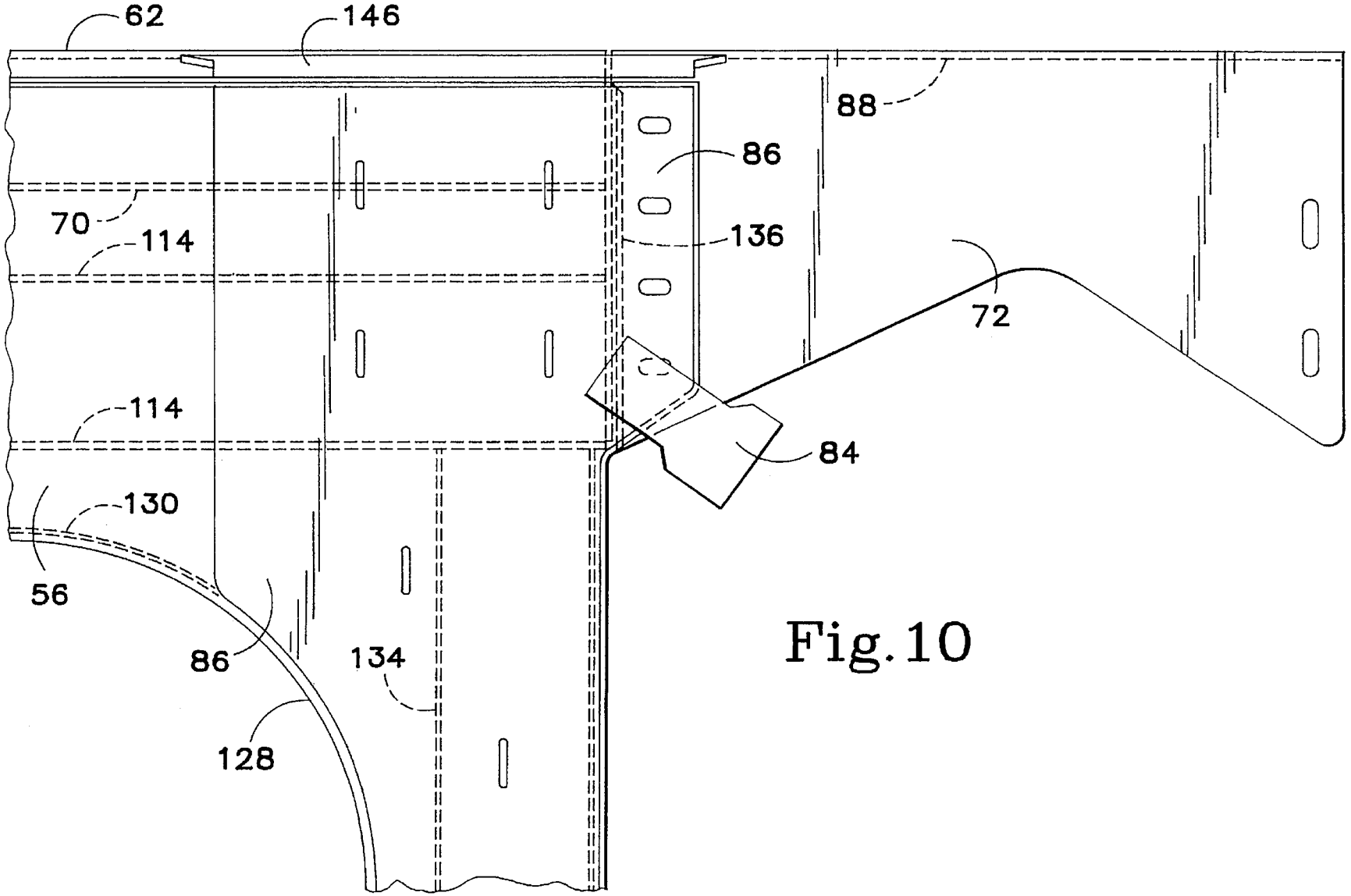
FIG. 10 is a bottom view of part of the portion of a well floor assembly shown in FIG. 10.
Figure 11:
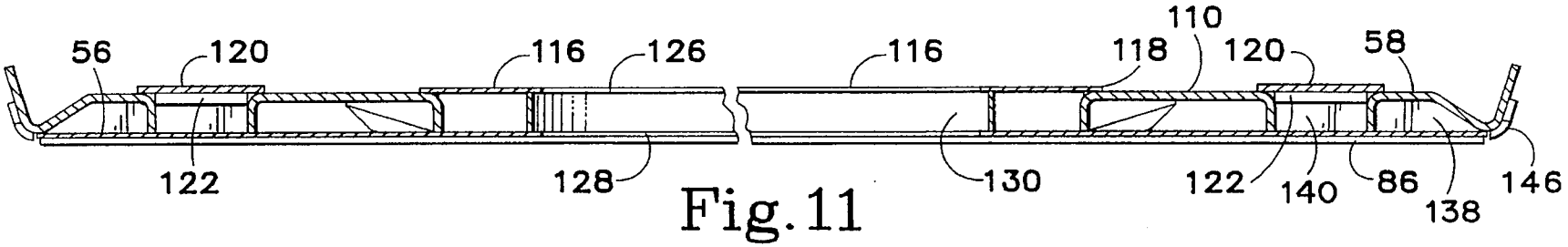
FIG. 11 is a sectional view, at an enlarged scale, of a portion of the well floor assembly shown in FIG. 9, taken along line 11—11.
Figure 12:
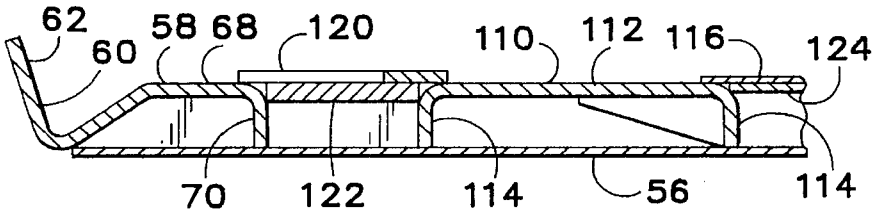
FIG. 12 is a sectional view, at an enlarged scale, of a portion of the well floor assembly shown in FIG. 9, taken along line 12—12.
Figure 13:
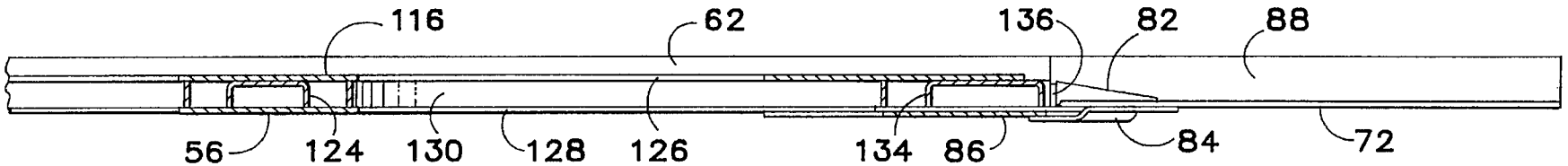
FIG. 13 is a sectional view, at an enlarged scale, of a portion of the well floor assembly shown in FIG. 9, taken along line 13—13.

The floor assembly 26 is further strengthened by several transversely extending beams in the form of downwardly-open channels 124, of bent plate ¼ inch thick, for example, whose flanges are welded to the bottom plate 56 at locations spaced apart longitudinally along the main portion 54 of the floor assembly 26. The top plate 116 is welded to the web of each transverse channel 124 through conventional openings provided for that purpose. A similar but wider transversely extending end channel 134 is located at each end of the main portion 54 of the floor assembly, as shown in FIGS. 6 and 10.

In order to provide additional stiffness while also reducing the weight of the bottom assembly 26, the bottom plate 56 and the top plate 116 each respectively define several large openings 126 and 128, preferably circular in shape, of equal size, and located directly above one another. A stiffener 130 extends vertically between the bottom plate 56 and top plate 116 and surrounds the large openings 126 and 128. The stiffener 130 is of metal plate material ¼ inch thick, for example, forming a circular wall enclosing the large openings 126 and 128. The stiffener 130 is welded to both the bottom plate 56 and top plate 116 about the entire periphery of the large openings 126 and 128, interconnecting the top plate 116 and the bottom plate 56 as a stiff structure. The height of the longitudinal channels 110, establishing the distance separating the bottom plate 56 from the top plate 116, may be 2-9/32 inch, for example, and the stiffener 130 correspondingly has a height of 2-9/32 inches.

In a car 20 in which the length 36 of the well 22 is slightly greater than 48 feet, in order to receive a nominally 48-foot-long cargo container, preferably eight sets of corresponding vertically aligned large openings 126, 128 are provided, each having a diameter 132 of 44 inches, with the circular stiffeners 130 having an inside diameter of 45 inches, providing an overhang of about ½ inch of the margins of the top plate 116 and bottom plate 56 inside the stiffeners 130 to allow for convenient welding and stress relief.

As shown also in FIGS. 9, 10, 12 and 13, the transverse channel members 124 are located between the adjacent pairs of large openings and the similar, but wider, transverse end channels 134 are located between the top plate 116 and bottom plate 56 at each end of the main portion 54 of the floor assembly 26, adjacent the well floor end transition portions 52.

In order to provide adequate strength for transfer of loads from the main portion 54 of the well floor assembly 26 to the end transition portion 52 at each end, and ultimately to the body bolster 30, a respective doubler plate 86 is welded to the underside of the bottom plate 56 adjacent each end of the main portion 54, extending about two feet toward the center of the length of the car body 21. A portion of the doubler plate 86 extends longitudinally outward beyond the wide transverse end channel member 134 at each end of the main body portion 54 and is welded to the bottom side of the respective transition plate 72 at each side of the floor assembly 26. The respective bottom attachment plate 84 for each diagonal box beam 76 is bent to fit closely along the bottom side of the doubler plate 86 and extends thence along the bottom side of the transition plate 72.

An end cap 136 extends vertically and transversely across the ends of the transition channel member 58 and the downwardly open longitudinal channel 110 on each side at each end of the main portion 54. Each transition ramp 82 is welded to the respective end cap 136 and extends slopingly from it to the top surface of the transition plate 72.

Figure 9:
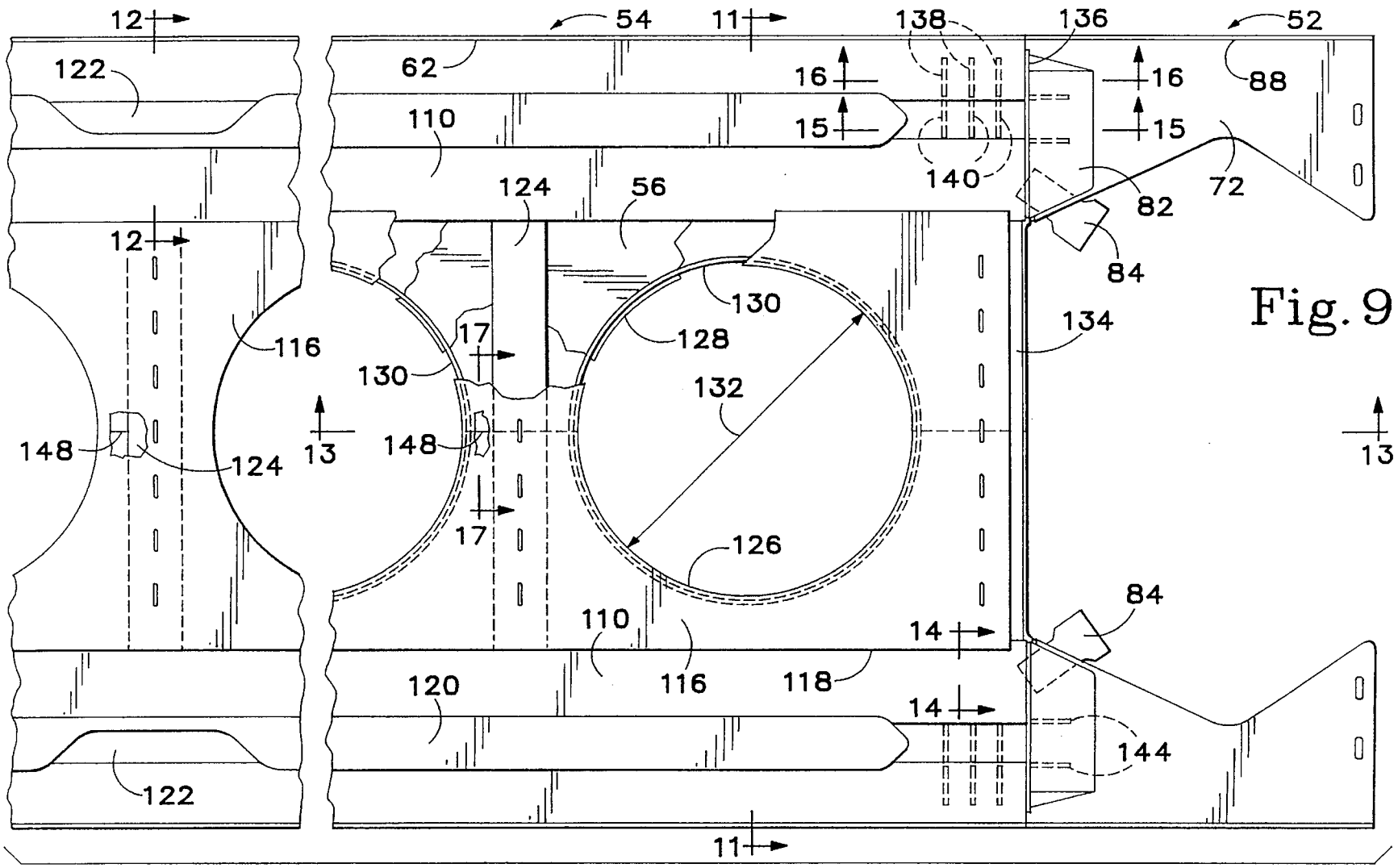
FIG. 9 is a partially cut-away, top plan view, at an enlarged scale, of a portion of the well floor assembly of the railroad freight car shown in FIGS. 1–3.
Figure 15:
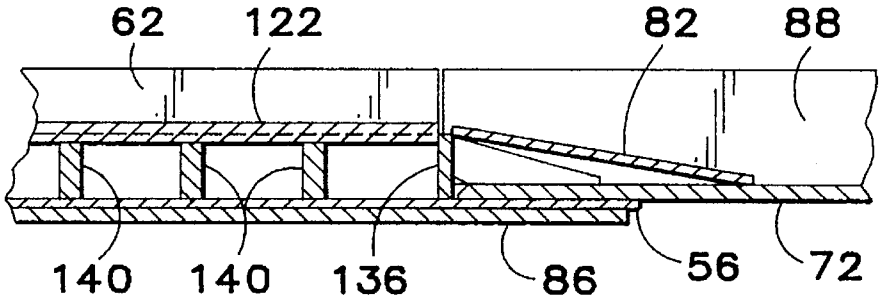
FIG. 15 is a sectional view, at an enlarged scale, of a portion of the well floor assembly shown in FIG. 9, taken along line 15—15.
Figure 14:
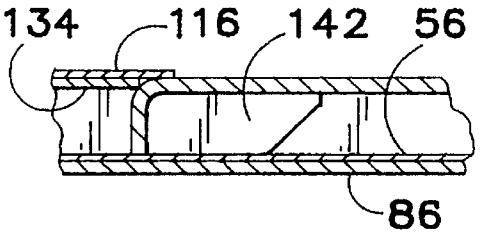
FIG. 14 is a sectional view, at an enlarged scale, of a portion of the well floor assembly shown in FIG. 9, taken along line 14—14.
Figure 16:
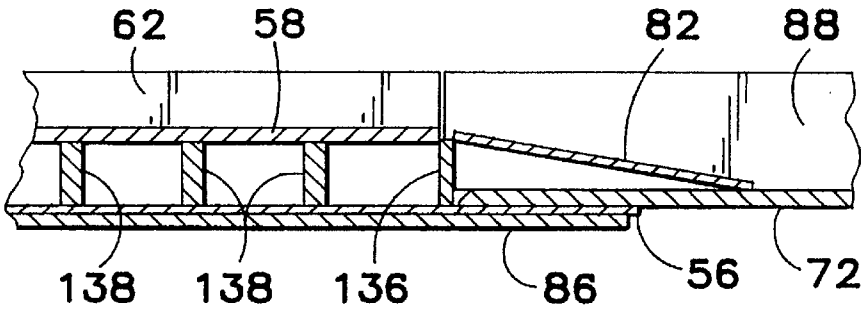
FIG. 16 is a sectional view, at an enlarged scale, of a portion of the well floor assembly shown in FIG. 9, taken along line 16—16.

Groups of transverse reinforcing pieces 138 and 140 extend vertically between the bottom plate 56 and the underside of the transition channel member 58 and the doubler plate 86, respectively, near each corner of the main portion 54 of the floor assembly 26, as shown in FIGS. 9, 15, and 16. A transition plate 142, shown in FIGS. 9 and 14, provides additional support for the longitudinal channel member 110 at each end of the main portion 54, extending vertically and laterally adjacent the end cap 136.

A "J"-shaped doubler 146 is located on the outer side of the floor assembly 26, below a part of the horizontal portion of each doubler plate 96 near the lower margin of each side sill 34. The J-shaped doublers 146 extend longitudinally over a distance extending slightly beyond the doubler plate 86, and thus reinforce a portion of the outer flange 88 of each transition plate 72 and a portion of the outer flange 62 at each end of each transition channel member 58. The outer diagonal flange 88 of each transition plate 72 also aids in the transmission of forces from the main portion 54 of the floor assembly 26 to the end transition portions 52.

Figure 17:
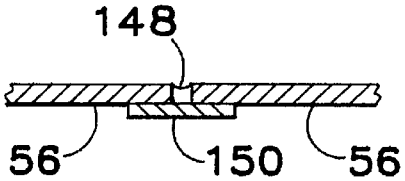
FIG. 17 is a sectional view, at an enlarged scale, of a portion of the well floor assembly shown in FIG. 9, taken along the line 17—17.

As shown in FIG. 17, except at the mid-length location along the floor assembly 26 the two longitudinally-extending halves of the bottom plate 56 are joined by a weld 148 and a reinforcing cover strip 150 extending longitudinally of the floor assembly 26 on the bottom side, at the ends of the main portion 54 and between the large openings 126 at places other than the mid-length location. However, at the mid-length position the cover strip 150 is preferably not used where track clearance height beneath the car is most critical.

Standard cargo container locator cones 152 are supported upon the reinforced portions of the corners of the main portion 54 of the well floor assembly 26, where the doubler plates 122 are not covered by the cover plates 120. At the mid-length portion of the car, between the middle pair of large openings 126, 128, the doubler plates 122 are also partially exposed as a landing spot for the corner posts of each of a pair of short containers carried end-to-end within the cargo well 22 as shown in FIG. 1.

Referring now to FIGS. 18–27, one end is shown of a railroad freight car 160, similar in most respects to the freight car 20. Except as to those elements which differ from corresponding elements of the freight car 20 previously described, the reference numerals used in FIGS. 1–17 will be used in FIGS. 18–27 to refer to like parts of the car 160.

Extending atop each side sill 34 of the body 21' of the car 160 is a respective side sill reinforcing structure 162 mounted atop the top chord 44 of the side sill 34. The side sill reinforcing structure 162 has a length 164, and extends longitudinally of the car and along side a portion of the cargo well 22, from a location adjacent the outer end 98 of the side sill 34, where it is connected with the body bolster 30. An end 166 of the side sill reinforcing structure 162 is aligned with the cargo container locator cone 152, which is located at the position longitudinally of the cargo well 22 where inter-box connectors (IBCs) are located to interconnect upper-tier and lower-tier containers 32 to each other in the cargo well 22. A trailer 24 is located in the cargo well 22, and a loading crane leg 168 is shown extending downward alongside the trailer 24, with its trailer-engaging foot 170 engaged with the bottom longitudinal frame rail of the trailer 24. The portion of the foot 170 which extends downward lower than the bottom of the trailer 24 has a thickness 172.

Figure 19:
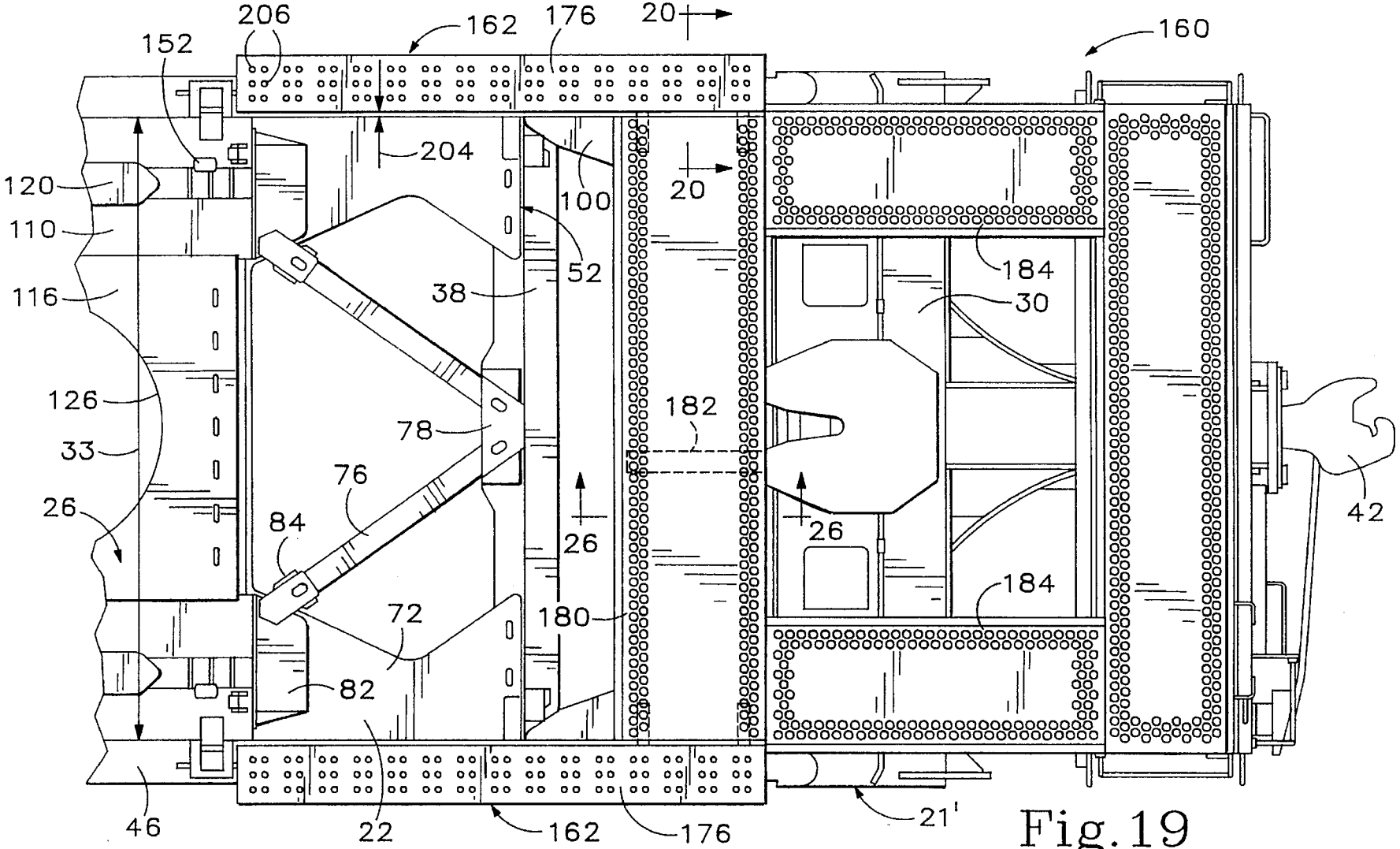
FIG. 19 is a top plan view of the body of the portion of a railroad freight car shown in FIG. 18.
Figure 26:
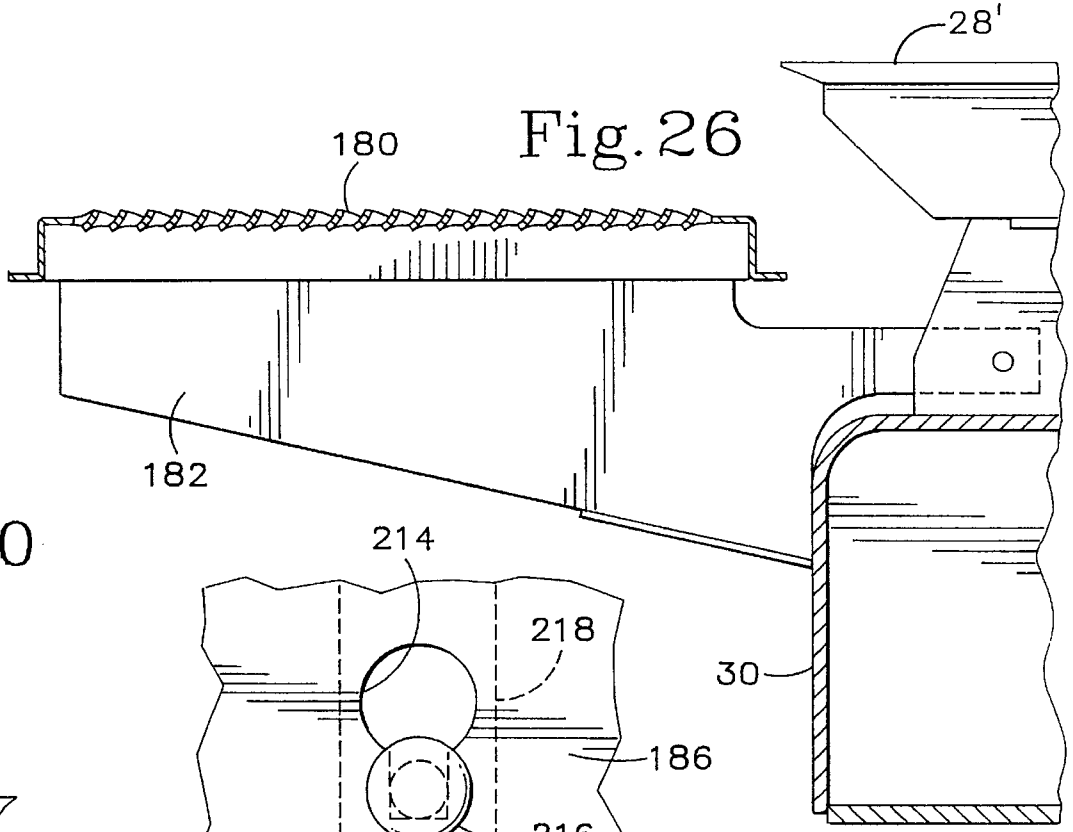
FIG. 26 is a sectional view, taken along line 26—26 of FIG. 19.
Figure 27:
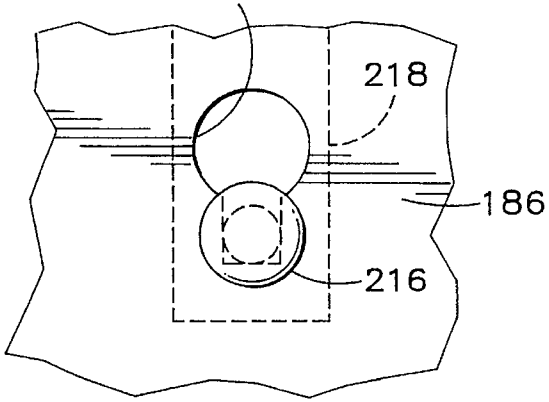
FIG. 27 is a detail view, at an enlarged scale, of the reinforcing walkway structure according to the present invention, taken along line 27—27 of FIG. 20.

A trailer hitch 28' is mounted atop the body bolster 30 and is oriented, as shown best in FIG. 19, so as to receive the hitch kingpin (not shown) of the trailer 24 as it moves into engagement with the trailer hitch 28' from the direction of the center of the car 160. In other respects, the trailer hitch 28' is similar to the trailer hitch 28 shown in FIGS. 1 and 2. The top surface of the trailer hitch 28' on which the bottom of the trailer 24 rests, has a height 174, of several inches above the top of the top chord 44, for example, as much as 12-½ inches.

Figure 18:
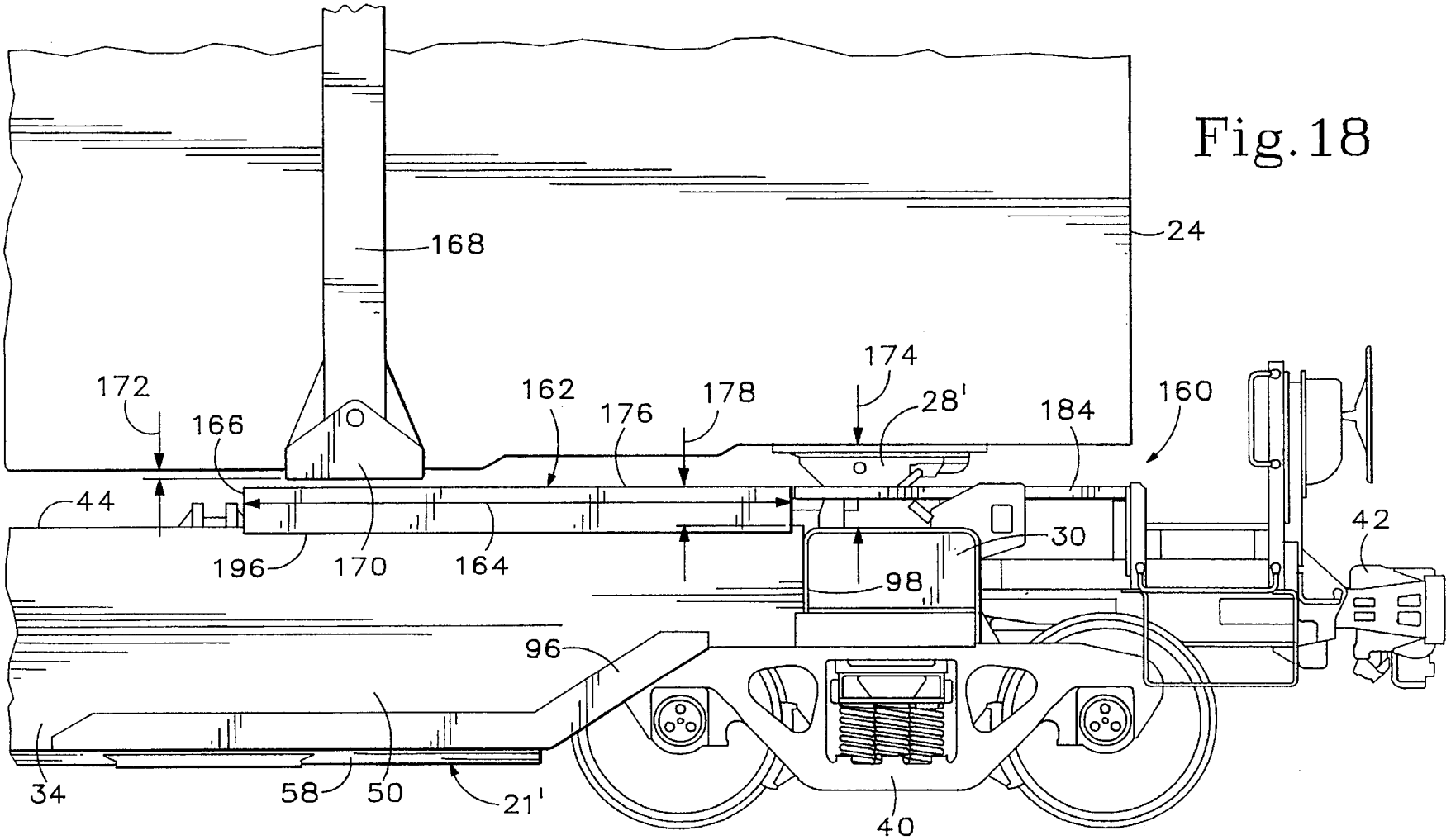
FIG. 18 is a side elevational view of a portion of a railroad freight car which is an alternative embodiment of the present invention, together with portions of a trailer and a loading crane engaging a lift point along a lower longitudinal frame member of the trailer.

The reinforcing structure 162 has a horizontal top 176, located above the top of the top chord 44 at a height 178, which is less than the height 174. The height 178 is smaller than the height 174 by a distance great enough to leave, at a minimum, sufficient clearance for the thickness 172 of the foot 170 of the loading crane leg 168. The difference between the height 178 and the height 174 may preferably be greater, as shown in FIG. 18, in order to accommodate a trailer 24 in which the bottom longitudinal frame rail may be located lower than the turntable surface on the bottom of the trailer. At the same time, however, the height 178 is great enough so that a person standing atop the horizontal top 176 of the reinforcing structure 162 will be able to reach an IBC used to attach an upper-tier container 32 to a lower-tier container 32.

A transverse horizontal walkway 180 extends between opposite reinforcing structures 162 and is supported, in part, by attachment to the reinforcing structure 162 on each side of the car 160. A support 182 is mounted on the body bolster 30 and supports a central portion of the transverse walkway 180. A respective one of a pair of longitudinal walkways 184 extends toward the end of the car 162 from the transverse walkway 180, on each side of the car 160, as may be seen in FIG. 19.

Figure 20:
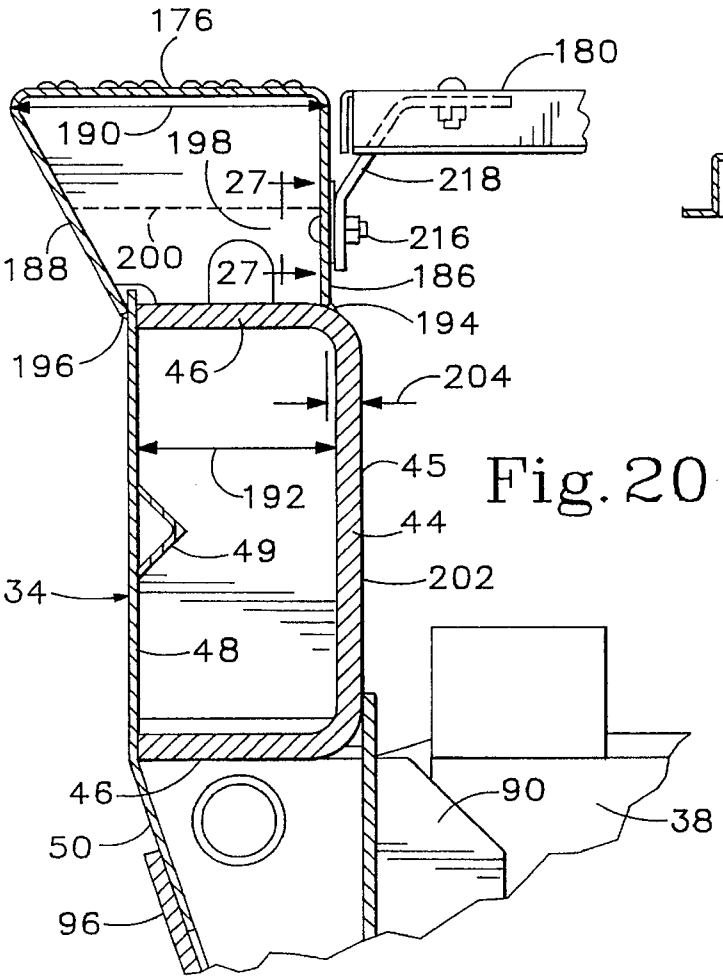
FIG. 20 is a sectional view, taken along line 20—20 of FIG. 19, showing a portion of a side sill and an associated reinforcing walkway structure which is part of the railroad freight car shown in FIGS. 18 and 19.
Figure 21:
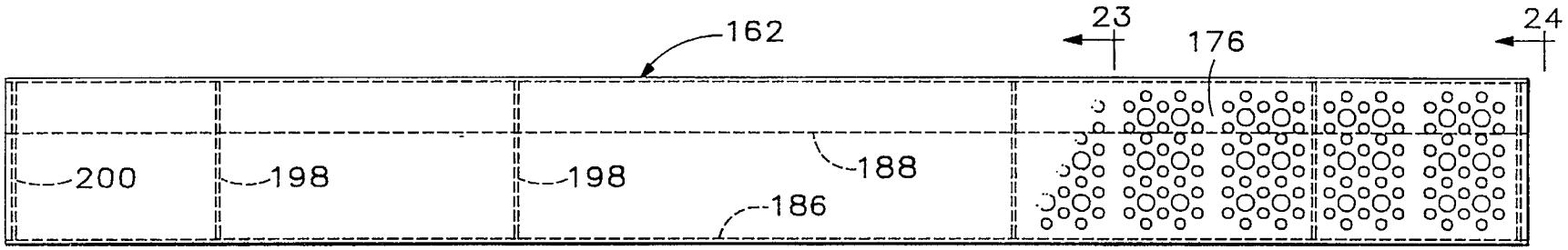
FIG. 21 is a top plan view, at an enlarged scale, of the reinforcing walkway structure shown in FIGS. 18–20, at an enlarged scale.

Preferably, as may be seen in FIG. 20, the reinforcing structure 162 includes a main member in the form of a channel having the shape of an inverted U, with the horizontal top 176 forming the base of the U. The legs of the U are an inner leg 186 extending longitudinally of the car 160 and oriented vertically, and an outer leg 188 which extends diagonally downwardly and inwardly toward the top chord 44 of the side sill 34. The width 190 of the horizontal top 176 is thus greater than the width 192 of the top chord 44, so that the horizontal top 176 of the reinforcing structure provides a greater area than that of the top of the top chord 44, for a person to stand upon while operating IBCs. Because the reinforcing structures 162 are close to the ends of the car 160, there is sufficient room for such laterally outward protrusion of the reinforcing structure 162, despite the need for the longitudinally central portions of the side sills to be spaced closer together in order for the car 160 to negotiate curves safely.

The channel member of the reinforcing structure 162 is preferably manufactured of steel plate, for example ¼ inch thick, bent to the required shape. The channel is reinforced by three intermediate stiffener plates 198 and a pair of end stiffener plates 200, each welded to the channel at the appropriate location. The lower margins of the inner leg 186 and outer leg 188 of the reinforcing structure 162 are welded to the top chord 44, preferably along substantially their entire length, as shown at 194 and 196, respectively. The reinforcing structure 162 is welded atop the top chord 44 with the inner leg 186 spaced outwardly from the inner face 202 of the top chord 44 by a distance 204 of, for example, 1.25 inches, in order to reduce somewhat the likelihood of the reinforcing structure 162 being struck by a container 32 or trailer 24 being moved into or out of the cargo well 32. At the same time, however, the reinforcing structure 162 is strong enough to withstand the weight of a container 32 or trailer 24, should it be lowered accidentally onto the horizontal top 176, and is substantial enough to strengthen the side sill 34 where its lower margin slopes upward to provide clearance for the truck 40.

Figure 25:
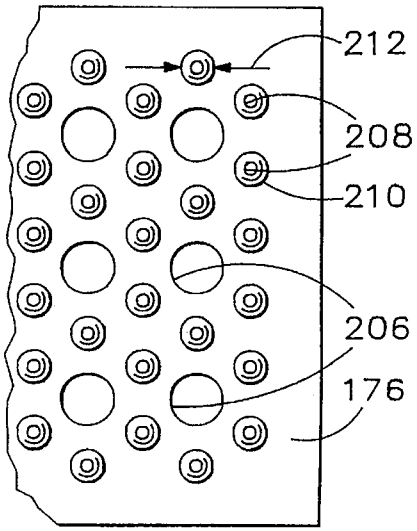
FIG. 25 is a top plan view of a detail of the reinforcing walkway structure shown in FIGS. 18–24, at a further enlarged scale.
Figure 24:
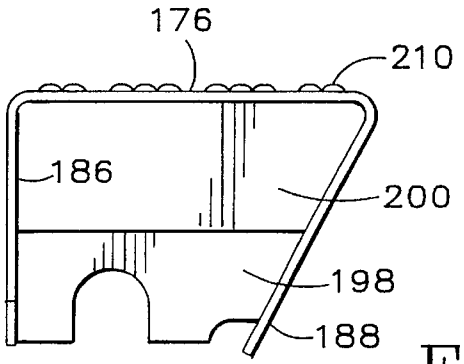
FIG. 24 is a sectional view of the reinforcing walkway structure shown in FIGS. 18–22, taken along line 24—24 of FIG. 21, at a further enlarged scale.
Figure 23:
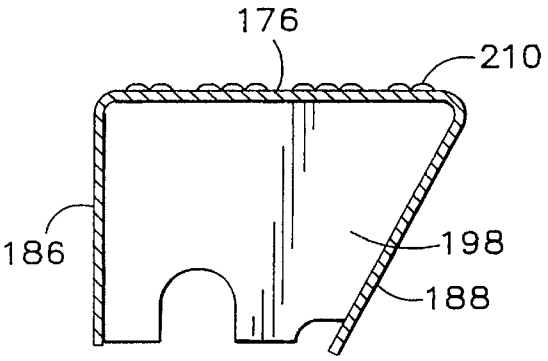
FIG. 23 is a sectional view of the reinforcing walkway structure shown in FIGS. 18–22, taken along line 23—23 of FIG. 21, at a further enlarged scale.

The horizontal top 176 is perforated, defining a pattern of large, generally circular holes 206 each having a diameter of, for example, about 1 inch, surrounded by a pattern of smaller holes 208, each having a diameter of, for example, ¼ inch. Each of the smaller holes 208 is surrounded by a raised annular rim 210, the holes 208 and rims 210 together forming a raised perforated dimple having a diameter 212 of, for example, ⅝ inch. The arrangement of holes 206 and surrounding perforated dimples, as shown in FIG. 25, provides ample space for rain or slush to fall downward through the horizontal top 176, clearing the horizontal top 176 sufficiently that it provides a reliable non-skid walkway surface.

Alternatively, another type of non-skid surface (not shown), such as use of non-skid paint or other surface covering, or a non-skid surface configuration of raised ridges in a basket-weave pattern, commonly known as "diamond tread," might be used atop the horizontal top 176.

The pattern of holes 206 and 208, on the other hand, leaves most of the metal of which the horizontal top 176 is made. Ample strength, then, is still provided by the reinforcing structure 162, both to carry some of the structural loads in that portion of the side sills 34 and to resist damage from inadvertently being struck by containers 32, trailers 24, or equipment used to handle them.

Figure 22:
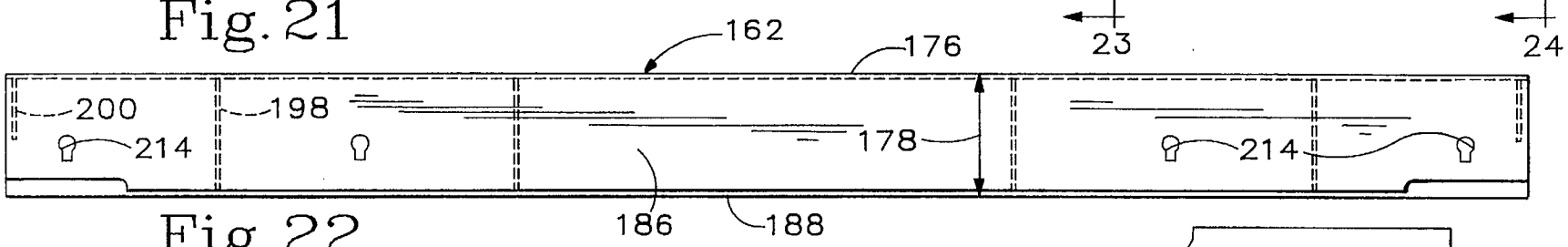
FIG. 22 is a side elevational view of the reinforcing walkway shown in FIG. 21, taken from within the cargo well of the car shown in FIGS. 18 and 19.

As may be seen more particularly in FIG. 22, the reinforcing structures 162 are symmetrical, and include a pair of keyhole-shaped openings 214 near each end of the inner leg 186 to receive a fastener such as a bolt 216 attaching a bracket 218 to support the transverse walkway 180. The transverse walkway 180 may be of a conventional construction of expanded metal providing ample strength to support a worker, but, since it is not intended to add significantly to the structural strength of the car body, the transverse walkway 180 need not be of such substantial material as the reinforcing structure 162.

Referring now to FIGS. 28–35, a multi-unit railway freight car 218 embodying the invention preferably includes at least two car units 220 semi-permanently interconnected. More specifically, in an embodiment having three car units 220, the three car units 220 may be identified as a front end or first car unit 232 (which may be referred to as an A end unit in the industry), an intermediate or second car unit 230 (which may be referred to as a C unit in the industry), and a rear end or third car unit 234 (which may be referred to as a B end unit and usually includes the hand brake mechanism of the freight car 218). Except as to those elements which differ from corresponding elements of the freight cars 20 and 160 previously described, the reference numerals used in FIGS. 1–27 will be used in FIGS. 28–35 to refer to like parts of the car units 220.

Figure 28:
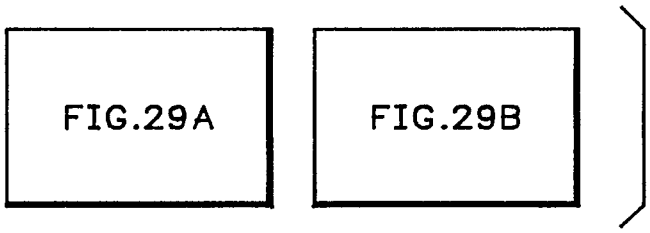
FIG. 28 is a diagram showing the proper relative arrangement of FIGS. 29A and 29B.
Figure 29A:
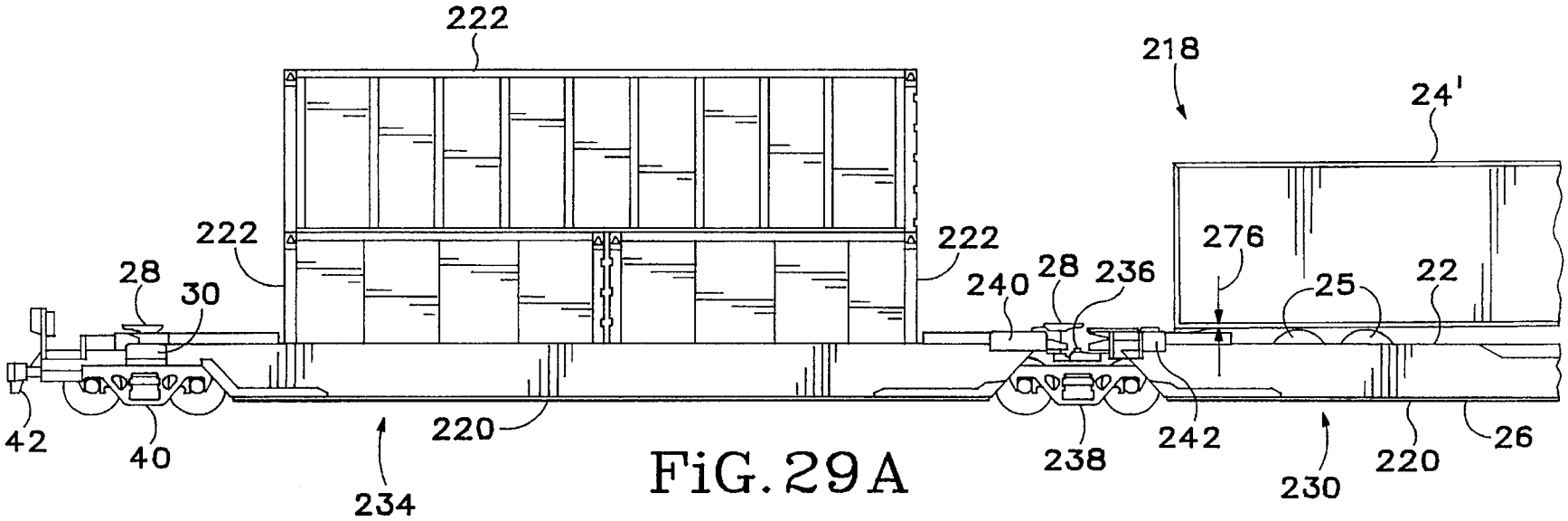
FIGS. 29A and 29B, taken together are a side elevational view of a preferred embodiment of a multi-unit railway freight car for carrying either intermodal cargo containers or over-the-highway freight trailers.
Figure 29B:
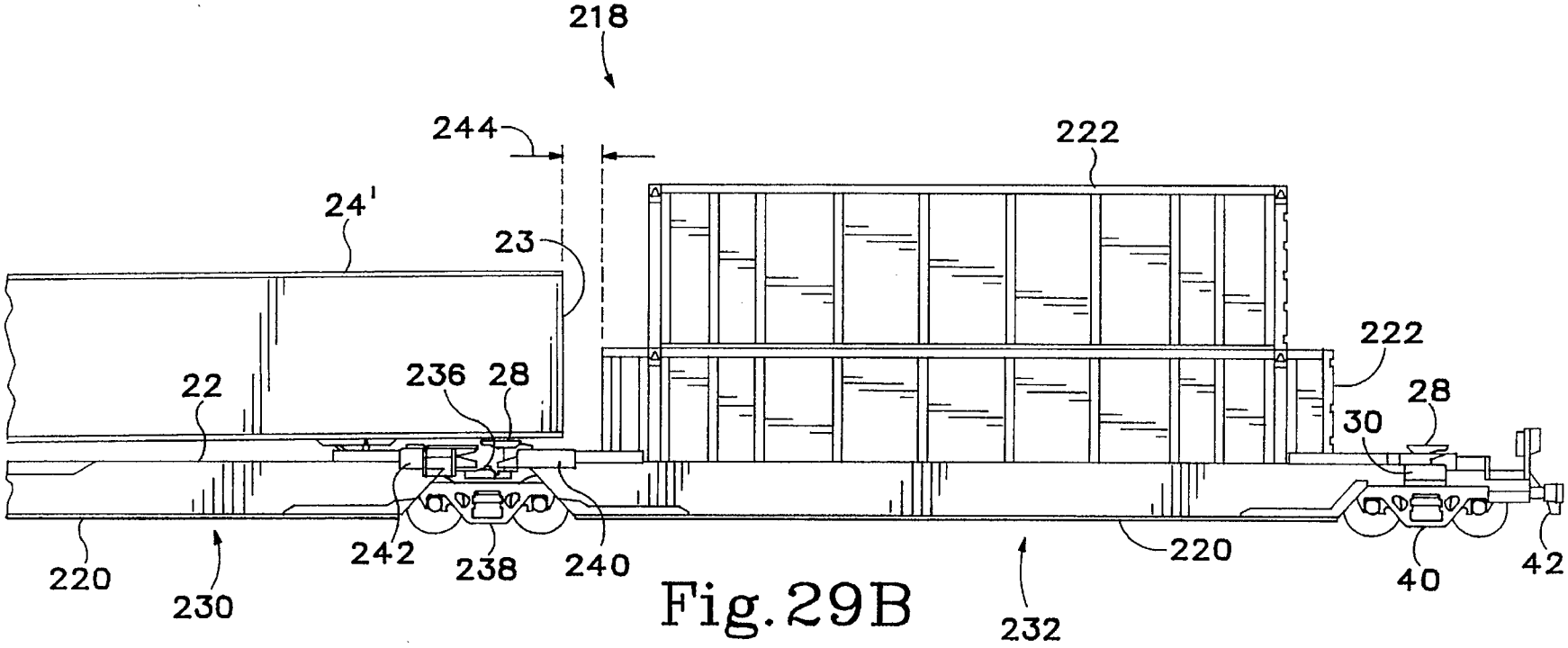

As may be seen in FIGS. 29A and 29B (arranged as shown in FIG. 28), the multi-unit railway freight car 218 includes three interconnected car units 220 which are adapted for carrying either intermodal cargo containers 222 of various sizes (such as the upper-tier containers 32 and lower-tier containers 32 discussed above) or over-the-highway freight trailers 24. Accordingly, a multi-unit railway freight car 218 may carry various combinations of intermodal cargo containers 222 and freight trailers 24. A freight trailer 24 generally includes a hitch kingpin 224 (FIG. 31) at a front end 23 of the trailer 24 and road wheels 25 at the back end of the trailer 24. A freight trailer 24 may also include landing gear 226 shown in phantom line in FIG. 31, spaced a small distance rearward from the hitch kingpin 224.

Figure 30:
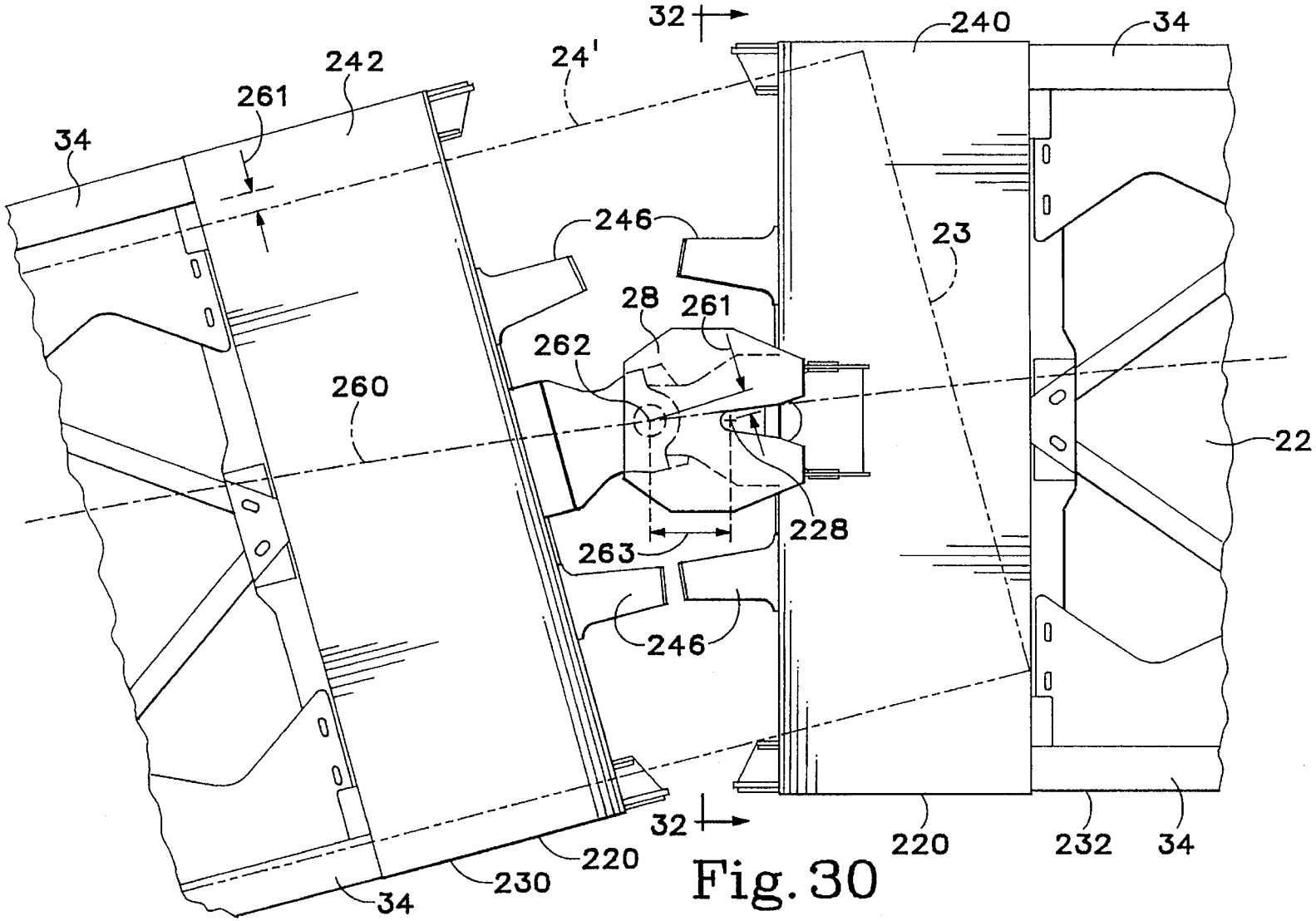
FIG. 30 is a top plan view, at an enlarged scale, of an interconnection between two car units of the multi-unit railway freight car shown in FIGS. 29A and 29B.

As discussed previously, some freight trailers are longer than cargo wells 22 of the car units 220. Accordingly, a multi-unit railway freight car 218 of the present invention is designed to carry over-length freight trailers 24' which are longer than the cargo wells 22 of the car units 220, as shown in FIGS. 29A and 29B, by using a pair of adjacent interconnected car units 220 to jointly support a single long freight trailer 24'. As shown in FIG. 30, adjacent car units 220 of the car 218 are preferably interconnected by an articulated connector 236 to connect one end of a first car unit 232 to an end of an adjacent, second, or intermediate car unit 230. Such articulated connectors 236 are well known in multi-unit freight cars and allow adjacent ends of the car units 220 interconnected thereby to be supported by a single shared wheeled truck 238. A suitable articulated connector 236 and shared wheeled truck 238 are disclosed in U.S. Pat. No. 5,207,161, owned by the assignee of this application.

Each end of the multi-unit railway freight car 218, as shown in FIGS. 29A and 29B, may further include a conventional wheeled truck 40 which supports the respective free, or unarticulated, end of each of the end car units 232 and 234.

Figure 31:
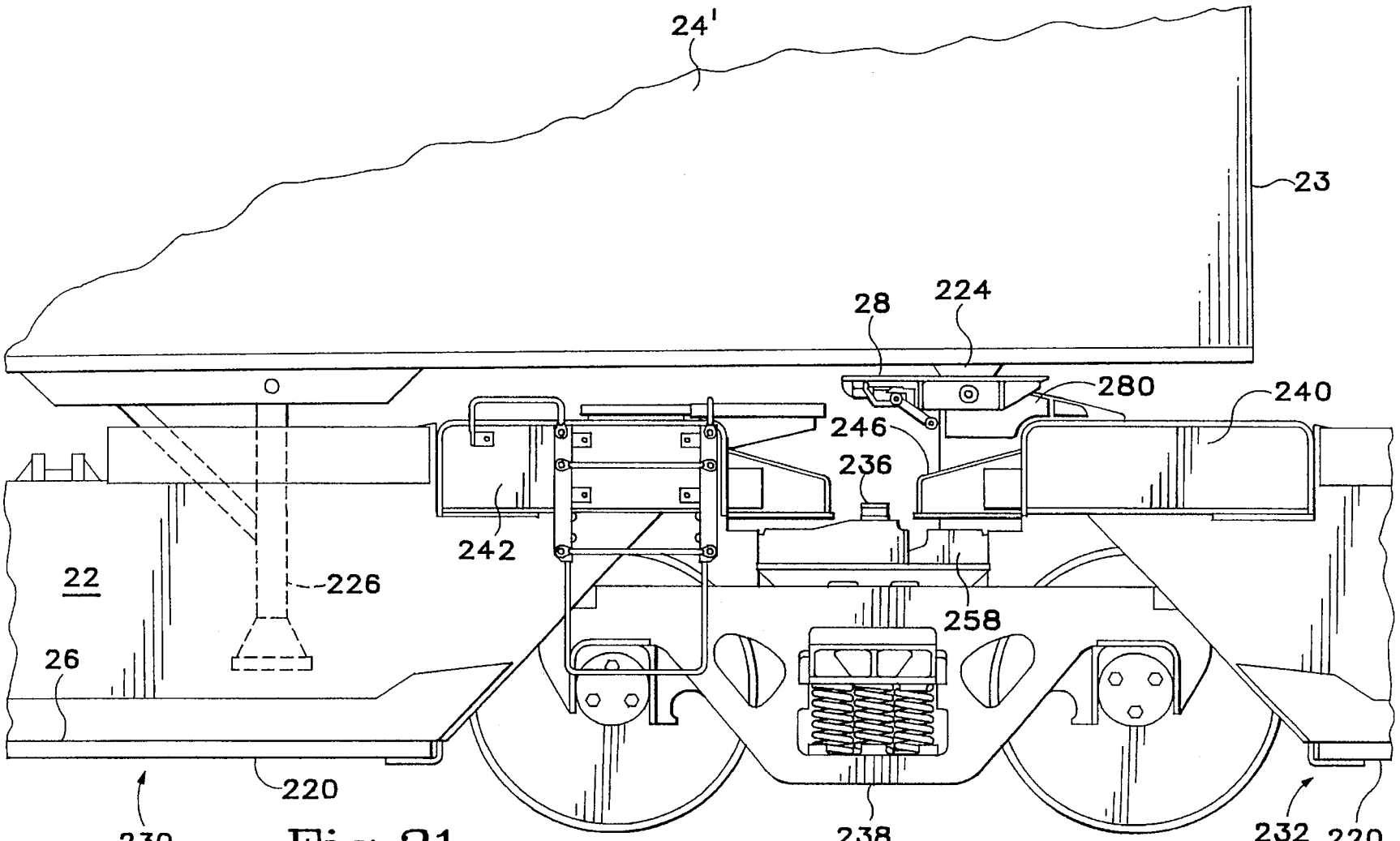
FIG. 31 is a side elevational view, at an enlarged scale, of adjacent portions of two interconnected car units of the car shown in FIGS. 29A and 29B, jointly supporting a front end of an over-the-highway freight trailer.

FIGS. 30 and 31 show a trailer hitch 28 which may receive and pivotally secure a hitch kingpin 224 of a trailer 24'. The trailer hitch 28 is shown supported on the first car unit 232 of two interconnected car units 220. The end of the first unit 232 which supports the trailer hitch 28 preferably includes a body bolster 240 extending transversely to the first car unit 232.

Figure 32:
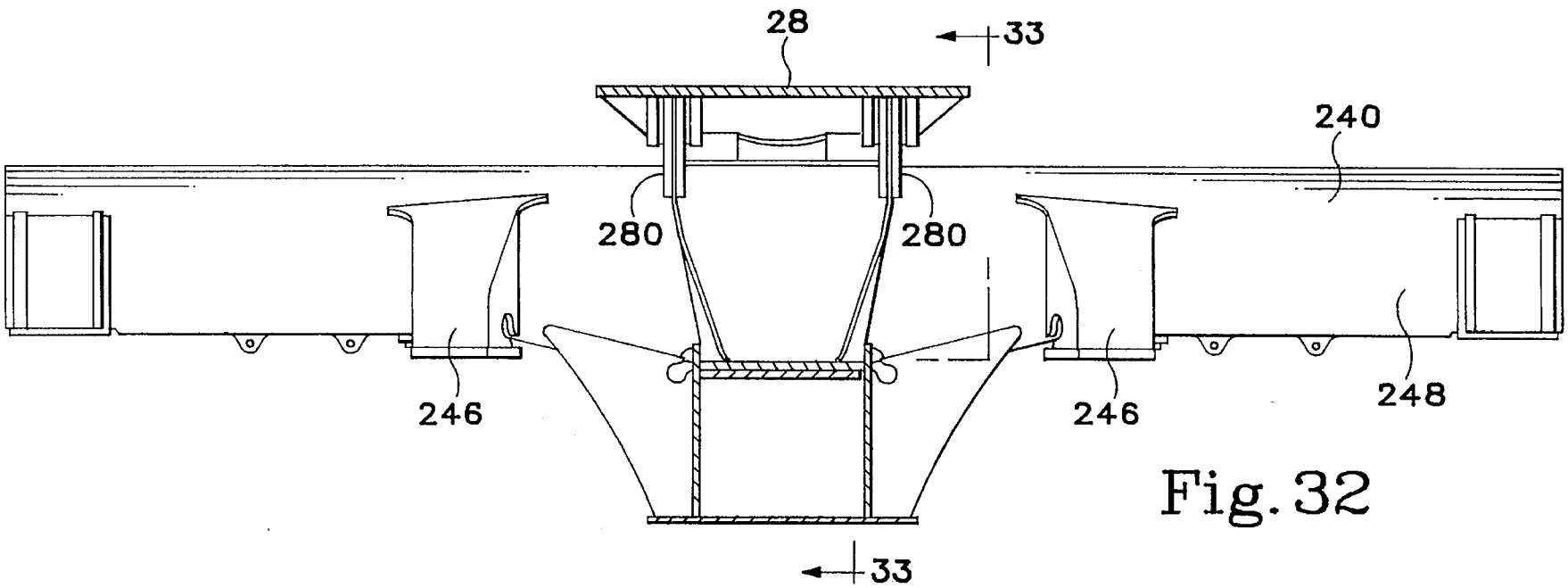
FIG. 32 is a end view of the body bolster and trailer hitch of the car unit shown in FIG. 30, taken along line 32—32, at an enlarged scale.
Figure 33:
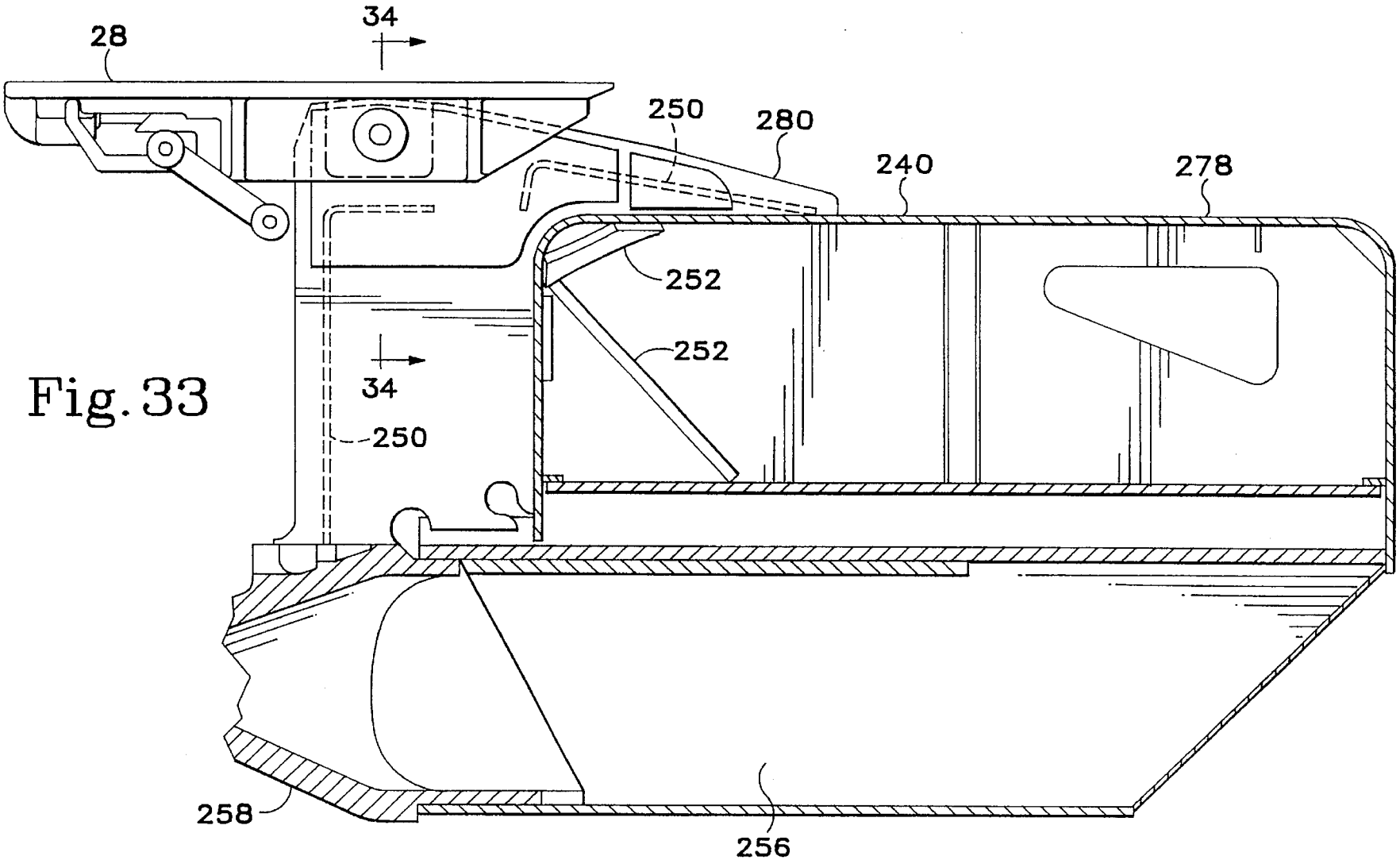
FIG. 33 is a sectional view of the body bolster and trailer hitch shown in FIG. 32, taken along line 33—33, at a further enlarged scale.
Figure 34:
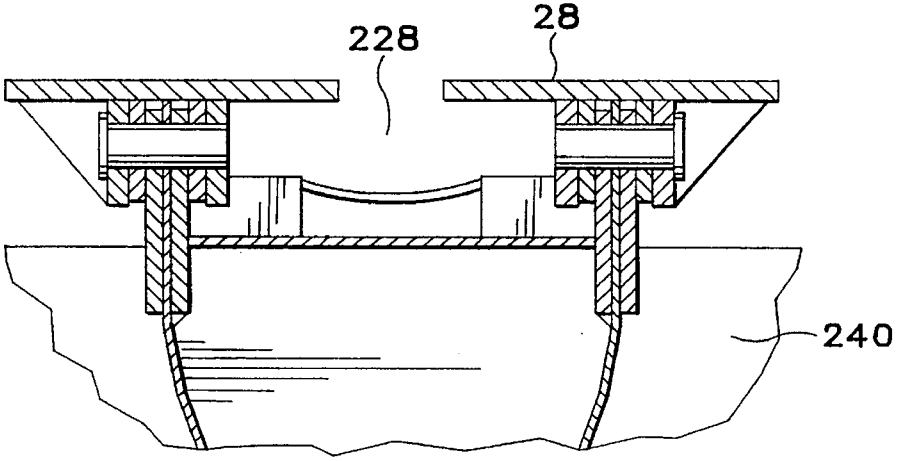
FIG. 34 is a sectional view of the body bolster and trailer hitch shown in FIG. 33, taken along line 34—34.

FIGS. 32–34 show the internal support structure of a body bolster 240 supporting a trailer hitch 28. A body bolster 242 constructed similarly to body bolster 240 is similarly included in the interconnected adjacent ends of each of the car units 220 not supporting a trailer hitch 28. Body bolsters 240 and 242, like body bolsters 30, discussed above, interconnect the side sills 34 (FIG. 30) and the stub center sill 256 of each of the car units 220.

As shown in FIGS. 30 and 31, the trailer hitch 28 supported by the body bolster 240 of the first car unit 232 defines a hitch kingpin location 228 (also shown in FIG. 34) situated longitudinally between the body bolster 240 of the first end car unit 232 and the body bolster 242 of the second or intermediate car unit 230. As shown herein, the interconnected car units 220 share a wheeled truck 238, and the hitch kingpin location 228 is preferably located above the shared wheeled truck 238.

FIG. 30 also shows the relative positions of a trailer 24' (shown in phantom line) and the car units 230 and 232 located on a length of a railroad track (not shown) curved at a minimum radius, as shown by the broken line 260 representing the center line of the track. As the multi-unit railway freight car 218 negotiates such curved track, there should be sufficient clearance along both sides for the car and its load to fit within the appropriate American Association of Railroads clearance plates. Accordingly, the sideways displacement 261 of the trailer 24' resulting from negotiating a curve preferably does not cause the trailer 24' to extend beyond the outside of the side sills 34. To limit the sideways displacement 261, the horizontal distance 263, measured longitudinally of the car 218, between the center of the hitch kingpin location 228 and the center of the articulated connector pin location 262, is relatively short, for example, 8-13/16 inches.

Finally, as the car 218 negotiates curves the front end 23 of the trailer 24' should not contact containers 222 or other cargo carried in the well 22 of the car unit 232 on whose body bolster 240 the front of the trailer 24' is supported. To prevent this contact, there should be a minimum distance 244 (FIG. 29B) of approximately 14 inches between the front of the long trailer 24' and containers 222 in the adjacent car unit 220, when the loaded car 218 is on a tangent track.

The second, or intermediate car unit 230 of the two interconnected car units 220 includes a cargo well 22 which preferably includes trailer road wheel-supporting floor structure 26 to support the road wheels 25 of the trailer 24' as shown in FIG. 29A and discussed above in relation to FIGS. 1 and 2. The floor structure 26 preferably has cargo container support structure associated therewith, also as discussed above. Also, each end of the car unit 230 should be low enough to allow for clearance 276 (FIG. 29A) beneath a chassis of a trailer 24 carried on its road wheels 25 in the well 22 and, accordingly, will generally not include a trailer hitch 28.

It should be noted that, in the three-unit car 218 shown herein, the trailer 24' may be carried in the well 22 of the intermediate unit 230, facing toward either end of the multi-unit railway freight car 218, by supporting the front end 23 of the trailer 24' on the trailer hitch 28 located on the body bolster 240 of the adjacent end of the end unit 232 or 234, whichever is the one closer to the front end 23 of the trailer 24'. The body bolsters 242 at both ends of the intermediate unit 230 are free of trailer hitches and other upwardly-extending structure, thus providing the necessary clearance 276 (FIG. 29A) for either end of the trailer 24' to overhang either of the body bolsters 242. For this reason, a car consisting of two end units 232, 234 and a single intermediate unit 230 is the preferred combination of car units. Additional intermediate units 230 interconnected by articulated connectors 236 and with their interconnected ends supported by shared wheeled trucks 238 could be included in a multi-unit car according to the invention.

Further, it should be noted that the heights 174 and 178 discussed above in connection with trailer hitch 28' and shown in FIG. 18 are generally applicable to the multi-unit railway freight car 218. More specifically, the height 174, between the top surface of the trailer hitch 28' on which the bottom of the trailer 24 rests and the top chord 44, is as much as 12-½ inches. Height 178 is smaller than the height 174 by a distance great enough to leave, at a minimum, sufficient clearance for the thickness 172 of the foot 170 of the loading crane leg 168.

FIGS. 32–34 show an exemplary structure of body bolster 240. On either side of the trailer hitch 28 is a side bearing support arm 246 mounted to the face 248 of the body bolster 240. Trailer hitch 28 is attached to a central portion 278 of the body bolster by an intermediate hitch support assembly 280 which has an essentially upside-down L-shaped interconnection to the upper-outer corner of the central portion 278. The lower edge of the central portion 278 and the intermediate hitch support assembly 280 connect with and are attached to a stub center sill 256 which facilitates interconnections between car units 220. The body bolster 240 has internal support structure to provide additional support and rigidity. Such internal support structure may include internal web structures such as transverse bracing plate structures 250 to add stiffness to the hitch support structure 280. Diagonal bracing members 252 are also included to support the hitch support structure 280. The stub center sill 256 has attached to its outer end a casting 258 which is a part of the articulated connector 236.

When an over-length trailer 24' is situated in the multi-unit railway freight car 218, the hitch kingpin 224 of the trailer 24' is secured to the trailer hitch 28 of a first car unit 232 and the road wheels 25 of the trailer 24' are situated atop the floor structure 26 within the well 22 of a second car unit 230 so that the front end 23 of the trailer 24' spans the interconnection between the two adjacent car units 220. Since the car units 220 as shown share a common truck 238, the front end 23 of the trailer 24 spans the shared truck 238. The two adjacent car units 230, 232 should be loaded so that the front end 23 of the trailer 24' is a minimum distance 244 which provides enough clearance to prevent the front end 23 of the trailer 24 from contacting the containers 222 or other cargo as the multi-unit car 218 negotiates curves in the track.

The multi-unit railway freight car of the invention may consist of any number of interconnected car units 220. For example, the embodiment shown in FIGS. 29A and 29B is a three-unit railway freight car 218 which consists of a front end car unit 232, an intermediate car unit 230, and a rear end car unit 234. Each of the end car units 232 and 234 is adjacent to one of the opposite ends of intermediate car unit 230, and each of the end car units 232 and 234 has one respective articulated connector end. Both of the opposite ends of the intermediate car unit 230 are articulated connector ends. Respective shared trucks 238 support the articulated connector end of each of the end car units 232 and 234 and a respective one of the articulated connector ends of the intermediate car unit 230. The intermediate car unit 230 of the multi-unit railway freight car 218 includes a cargo well 22. Further, the articulated ends of the end car units 232 and 234 of the multi-unit railway freight car 218 shown in FIGS. 29A and 29B support trailer hitches 28. The intermediate car unit 230 in these figures does not include a trailer hitch 28. Thus, the embodiment of the invention shown in FIGS. 29A and 29B allows a long trailer 24' to be carried in the intermediate car unit 230 and either shorter trailers 24 or containers 222 to be carried in the end car units 232 and 234.

Figure 35:
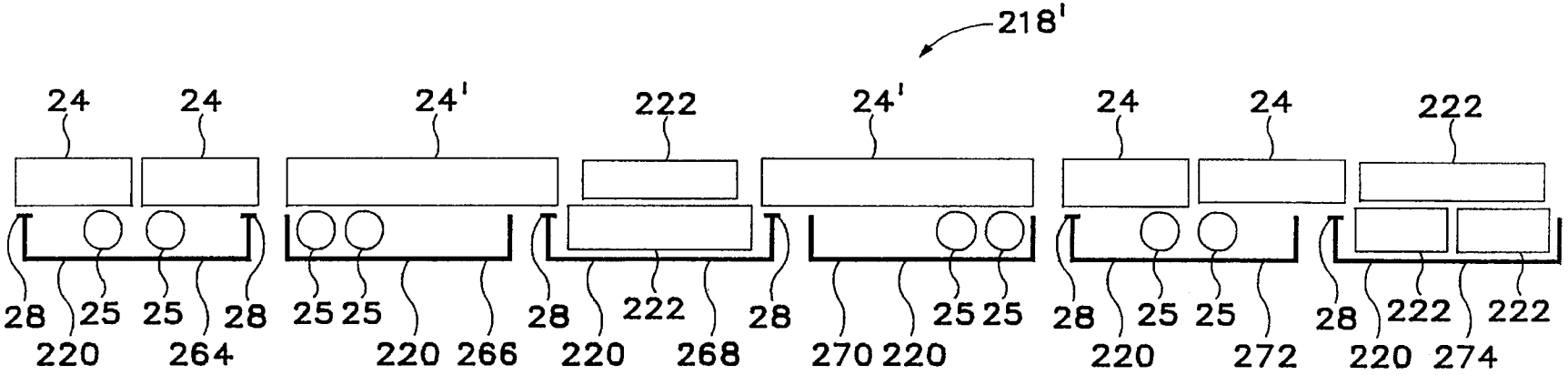
FIG. 35 is a simplified side view of an embodiment of a multi-unit railway freight car comprised of alternate embodiment car units.

Alternatively, as shown in FIG. 35, a multi-unit railway freight car 218' according to the invention could comprise a larger number of car units 220 each having one, two, or no trailer hitches 28. A car unit 264 having two trailer hitches 28 may carry two shorter trailers 24. Three car units 266, 268, and 270 can be arranged so that the end car units 266 and 270 which have no trailer hitches 28 each support trailer wheels 25 and the corresponding trailer hitch kingpins 224 (not shown) are connected to the trailer hitches 28 on either end of the intermediate car unit 268. The intermediate car unit 268 may then carry one or more containers 222 in its cargo well 22. Car units 272 and 274 which each include only one trailer hitch 28 may also be included and can support either trailers 24 or containers 222. These combinations are meant to be exemplary and are not meant to limit the scope of the invention.

The present invention also includes a method of carrying cargo, including an over-length freight trailer 24' having road wheels 25, in a multi-unit railway freight car 218. The first step of the method is to place and support the road wheels 25 of the trailer 24 on a cargo well floor 26 in a second car unit 230 of a pair of adjacent car units 220 having respective articulated connector ends supported on a shared wheeled truck 238. Next, a hitch kingpin 224 of the trailer 24' is coupled to a trailer hitch 28 mounted on an articulated connector end of a first car unit 232 of a pair of adjacent car units 220 so that the trailer hitch 28 supports a front end portion 23 of the trailer 24 above the articulated connector end of the first car unit 232 of the pair of adjacent car units, but without the front end portion 23 of the trailer 24' interfering with placement of cargo into a cargo well 22 of the first car unit 232. Finally, other cargo such as additional freight trailers 24 or one or more intermodal cargo containers 222 may be carried in the cargo well 22 of the first car unit 232 while the over-length trailer 24' is carried with its weight shared by the two adjacent car units.

The terms and expressions which have been employed in the foregoing specification are used therein as terms of description an not of limitation, and there is no intention, in the use of such terms and expressions, of excluding equivalents of the features shown and described or portions thereof, it being recognized that the scope of the invention is defined and limited only by the claims which follow.

What is claimed is:

1. A multi-unit railway freight car for carrying, optionally, intermodal cargo containers or highway freight trailers including road wheels, or both, comprising:

(a) at least two interconnected car units each having a pair of opposite ends, at least one of said opposite ends of each of a first car unit and a second car unit of said at least two inter-connected car units being an articulated connector end and said articulated connector end of said first car unit being connected to said articulated connector end of said second car unit;

(b) a plurality of wheeled trucks supporting said multi-unit railway freight car, at least one of said trucks being a shared truck supporting a pair of respective articulated connector ends of said at least two interconnected car units;

(c) a trailer hitch, carried on the articulated connector end of said first car unit, said trailer hitch having a first height;

(d) a cargo well included in the second car unit, said cargo well being proximate the articulated connector end of said second car unit, said articulated connector end of said second car unit being free from upward projections and including only structure of lesser height than said first height between said cargo well and said articulated connector end of said first car unit;

(e) a trailer road wheel-supporting floor structure in said cargo well for supporting road wheels of a freight trailer while said trailer hitch supports a kingpin of said freight trailer; and (f) cargo container support structure located within said cargo well for supporting a cargo container substantially as long as said cargo well.

2. The multi-unit railway freight car of claim 1 wherein each said articulated connector end includes a respective body bolster extending transversely of the respective car unit, said trailer hitch being supported by the body bolster of said first car unit and defining a hitch kingpin location above said shared truck and longitudinally between the body bolster of the first car unit and the body bolster of the second car unit.

3. The multi-unit railway freight car of claim 1 wherein said cargo well has a pair of opposite ends defining a length of the cargo well and wherein said floor structure extends over a majority of said length defined by said opposite ends of said cargo well.

4. The multi-unit railway freight car of claim 1 wherein each said car unit includes a pair of laterally apart-spaced side sills, a pair of body bolsters, and a floor, said side sills, body bolsters, and floor defining a cargo well having a depth above said floor less than said first height.

5. The multi-unit railway freight car of claim 1 wherein said at least two interconnected car units consist of an intermediate car unit and a pair of end car units, wherein one of the end car units is said first car unit and the intermediate car unit is said second car unit, each said end car unit being adjacent to a respective one of the opposite ends of said intermediate car unit, each said end car unit having a respective articulated connector end and each of said opposite ends of said intermediate car unit being an articulated connector end, and said shared truck supporting said articulated connector end of one of said end car units and a respective one of said articulated connector ends of said intermediate car unit.

6. The multi-unit railway freight car of claim 5, said intermediate car unit including said cargo well and said articulated connector end of each of said end car units including a respective trailer hitch, and said intermediate car unit being free of any said trailer hitch.

7. The multi-unit railway freight car of claim 5 wherein each of said end car units includes a respective cargo well and each of said opposite ends of said intermediate car unit has a trailer hitch located thereon, and said articulated connector end of each of said end car units being free of any said trailer hitch.

8. A multi-unit freight car for carrying, optionally, intermodal cargo containers or highway freight trailers including road wheels, or both, comprising:

(a) at least two interconnected car units each having a respective length and a pair of opposite ends;

(b) a plurality of wheeled trucks supporting said car units, at least one of said wheeled trucks being a shared truck;

(c) a first one and a second one of said car units being longitudinally adjacent each other and each having a respective articulated connector end, both of said respective articulated connector ends being supported by said shared truck;

(d) a respective body bolster included in each of said articulated connector ends and extending transversely of the respective one of said adjacent car units;

(e) a trailer hitch mounted on said body bolster of said first one of said car units, said trailer hitch defining a hitch kingpin interconnection structure located above said shared truck and longitudinally between said body bolsters of said articulated connector ends; and (f) said second one of said adjacent car units including a cargo well having a length extending over a majority of said length of said car unit and including container supports for therein receiving intermodal cargo containers substantially as long said cargo well and having a floor capable of supporting the road wheels of a highway freight trailer.

9. The multi-unit freight car of claim wherein said floor structure extends over a majority of said length of said cargo well.

10. The multi-unit freight car of claim wherein each of said car units includes a pair of side sills, a pair of body bolsters, and a floor defining a cargo well, said body bolsters having a first height above said floor and said trailer hitch having a second height above said floor, and wherein said second height is greater than said first height.

11. The multi-unit freight car of claim consisting of an intermediate car unit and a pair of end car units, one of said pair of end car units being said first one of said car units, and said intermediate car unit being said second one of said car units, said opposite ends of said intermediate car unit being a pair of said articulated connector ends, each said end car unit having a respective one of said articulated connector ends, each said respective articulated connector end of each said end car unit being adjacent to a respective one of said pair of opposite articulated connector ends of said intermediate car unit, and a shared truck supporting said articulated connector end of each of said end car units and one of said articulated connector ends of said intermediate car unit.

12. The multi-unit freight car of claim 11, said intermediate car unit further including a cargo well, and said articulated connector ends of said end car units including a respective trailer hitch, and said intermediate car unit being free of any said trailer hitch.

13. The multi-unit freight car of claim 11 wherein each of said end car units includes a respective cargo well and has a respective trailer hitch located at each of said opposite ends thereof.

14. The multi-unit freight car of claim 8 wherein each of said car units includes a respective cargo well having a respective trailer-wheel-supporting floor structure therein.

15. A method of carrying cargo in a multi-unit railway freight car, said cargo including an over-length highway freight trailer having road wheels at a back end and a hitch kingpin at a front end, said method comprising:

(a) supporting the road wheels of an over-length trailer on a cargo well floor in a second car unit of a pair of adjacent car units having respective articulated connector ends supported on a shared wheeled truck;

(b) connecting the hitch kingpin of said over-length trailer to a trailer hitch mounted on said articulated connector end of a first car unit of said pair of adjacent car units and thereby supporting a front end portion of said over-length trailer above said respective articulated connector ends; and (c) carrying other cargo optionally including a freight trailer or one or more intermodal cargo containers in said cargo well of said first car unit.

16. The method of claim 15, including the step of carrying two of said cargo containers stacked one atop the other in said cargo well of said first car unit while supporting said front end portion of said over-length trailer above said articulated connector end of said first car unit.

17. The method of claim 15 wherein said step of connecting the first end of said over-length trailer to a trailer hitch further includes supporting said front end portion of said over-length trailer without said front end portion extending above a cargo well of said first car unit.

18. In combination with a highway freight trailer including road wheels and having a hitch kingpin on a front end, multi-unit railway freight car for carrying, optionally, intermodal cargo containers, highway freight trailers, or both containers and trailers, said combination comprising:

(a) at least two interconnected car units including a first car unit and a second car unit interconnected with each other and each having a cargo well and a pair of opposite ends, at least one of said opposite ends of each of said first car unit and said second car unit being respective articulated connector ends interconnected with each other;

(b) a plurality of wheeled trucks supporting said car units; and (c) a trailer hitch, carried on the articulated connector end of the first car unit and located between the cargo well of the first car unit and the articulated connector end of the second car unit, said trailer hitch having hitch kingpin interconnection structure associated therewith; and (d) wherein said hitch kingpin of said freight trailer is coupled with said hitch kingpin interconnection structure of said trailer hitch to support the front end of said freight trailer in said first car unit and said road wheels of said freight trailer are supported in the cargo well of said second car unit.

19. The combination of claim 18, the front end of said freight trailer and the cargo well of the first car unit being free from overlap.

20. The combination of claim 18, at least one of said plurality of wheeled trucks being a shared truck supporting a pair of respective interconnected articulated connector ends of said at least two interconnected car units.

21. The combination of claim 18 wherein the cargo well in the second car unit includes a trailer road wheel-supporting floor structure.

22. The combination of claim 18, wherein each said articulated end of the at least two interconnected car units includes a respective body bolster extending transversely of the respective car unit, said trailer hitch being supported by the body bolster of said first car unit and defining a hitch kingpin location longitudinally between the body bolster of the first car unit and the body bolster of the second car unit.

* * * * *

UNITED STATES PATENT AND TRADEMARK OFFICE
CERTIFICATE OF CORRECTION

PATENT NO : 5,611,285
DATED : Mar. 18, 1997
INVENTOR(S) : Saxton

It is certified that error appears in the above-identified patent and that said Letters Patent is hereby corrected as shown below:

Title page, item [54] and col. 1,
Delete [RAILRAOD] and insert --RAILROAD--

Col. 16, line 64: Insert --8-- between "claim" and "wherein"

Col. 17, line 3: Insert --8-- between "claim" and "consisting"

Col. 18, line 8: Insert --a-- between "front end," and "multi-unit"

Signed and Sealed this

Twenty-first Day of September, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,611,285
DATED : March 18, 1997
INVENTOR(S) : Saxton

It is certified that error appears in the above-identified patent and that said Letters Patent is hereby corrected as shown below:

Column 16,
Line 61, insert -- 8 -- between "claim" and "consisting".

Signed and Sealed this

Eighth Day of January, 2002

*Attest:*

*Attesting Officer*

JAMES E. ROGAN
*Director of the United States Patent and Trademark Office*